US009370945B1

(12) United States Patent
Piatt et al.

(10) Patent No.: US 9,370,945 B1
(45) **Date of Patent: *Jun. 21, 2016**

(54) APPARATUS FOR REDUCING WRINKLES IN MOVING WEB

(71) Applicant: Eastman Kodak Company, Rochester, NY (US)

(72) Inventors: Michael J. Piatt, Dayton, OH (US); James A. Katerberg, Kettering, OH (US); Amit Singhal, Pittsford, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/569,903

(22) Filed: Dec. 15, 2014

(51) Int. Cl.

| | |
|---|---|
| ***B41J 2/01*** | (2006.01) |
| ***B41J 11/04*** | (2006.01) |
| ***B41J 15/04*** | (2006.01) |
| *B41J 15/16* | (2006.01) |

(52) U.S. Cl.
CPC *B41J 11/04* (2013.01); *B41J 15/04* (2013.01); *B41J 15/16* (2013.01); *B41J 15/165* (2013.01)

(58) Field of Classification Search
CPC ..... B41J 15/04; B41J 15/16; B41J 15/165; B41J 11/04; B65H 20/10
USPC ..... 347/104, 101, 16
See application file for complete search history.

(56) References Cited

U.S. PATENT DOCUMENTS

| | | | | |
|---|---|---|---|---|
| 4,186,860 | A | 2/1980 | Reba | |
| 5,299,364 | A | 4/1994 | Heikkila et al. | |
| 5,658,141 | A | 8/1997 | Larquet et al. | |
| 6,936,137 | B2 | 8/2005 | Moeller et al. | |
| 8,303,106 | B2 | 11/2012 | Kasiske, Jr. et al. | |
| 9,145,015 | B1 * | 9/2015 | Katerberg | B41J 15/04 |
| 9,201,369 | B1 * | 12/2015 | Piatt | G03G 15/325 |

* cited by examiner

*Primary Examiner* — Henok Legesse
(74) *Attorney, Agent, or Firm* — Amit Singhal; Kevin E. Spaulding

(57) ABSTRACT

A print media moving apparatus includes a vacuum assembly positioned immediately upstream relative to a roller. The vacuum assembly has an arcuate surface including three sections with the second section located between the first and third sections. The arcuate surface includes an extremum in the second section. The roller, having a diameter and rotational axis, includes three sections with the second section located between the first and third section as viewed along the rotational axis. The diameter of the roller in the first and third sections is greater than in the second section. The three sections of the vacuum assembly correspond to the three sections of the roller such that the contour of the arcuate surface causes the print media, after leaving the vacuum assembly, to contact the first and third sections of the roller prior to contacting the second section of the roller.

15 Claims, 20 Drawing Sheets

APPARATUS FOR REDUCING WRINKLES IN MOVING WEB

CROSS REFERENCE TO RELATED APPLICATIONS

Reference is made to commonly-assigned, U.S. patent application Ser. No. 14/569,910, entitled "APPARATUS FOR REDUCING WRINKLES IN MOVING WEB", Ser. No. 14/569,914, entitled "APPARATUS FOR REDUCING WRINKLES IN MOVING WEB", Ser. No. 14/569,921 (now U.S. Pat. No. 9,216,595), entitled "APPARATUS FOR REDUCING WRINKLES IN MOVING WEB", Ser. No. 14/569,924, entitled "APPARATUS FOR REDUCING WRINKLES IN MOVING WEB", Ser. No. 14/569,933 (now U.S. Pat. No. 9,201,369), entitled "METHOD FOR REDUCING WRINKLES IN MOVING WEB", Ser. No. 14/569,940 (now U.S. Pat. No. 9,145,015), entitled "METHOD FOR REDUCING WRINKLES IN MOVING WEB", all filed Dec. 15, 2014.

FIELD OF THE INVENTION

The invention relates generally to the field of digitally controlled printing systems, and more particularly to transporting a continuous web of print media through a printing system while reducing the formation of wrinkles in the web.

BACKGROUND OF THE INVENTION

In a digitally controlled printing system, such as an inkjet printing system, a print media is directed through a series of components. The print media can be a cut sheet or a continuous web. A web or cut sheet transport system physically moves the print media through the printing system. As the print media moves through the printing system, liquid, for example, ink, is applied to the print media by one or more printheads through a process commonly referred to as jetting of the liquid. The jetting of liquid onto the print media introduces significant moisture content to the print media, particularly when the system is used to print multiple colors on a print media. Due to its moisture content, the print media expands and contracts in a non-isotropic manner often with significant hysteresis. The continual change of dimensional characteristics of the print media often adversely affects image quality. Although drying is used to remove moisture from the print media, drying too frequently, for example, after printing each color, also causes changes in the dimensional characteristics of the print media that often adversely affects image quality.

FIG. 1 is a schematic of a portion of the print media as the print media passes over two conventional rollers that support the print media under each row of printheads. During an inkjet printing process, the print media can expand as the print media absorbs the water-based inks applied to it. When the direction of expansion is in a direction that is perpendicular to the direction of media travel 100, it is often referred to as expansion in the crosstrack direction 102. Typically, the wrap of the print media around a roller of an inkjet printing system produces sufficient friction between the print media and the roller that the print media is not free to slide in the crosstrack direction even though the print media is expanding in that direction. This can result in localized buckling of the print media away from the roller to create lengthwise ripples, also called flutes or wrinkles, in the print media. Flutes or ridges 104, 106 can be produced in the print media due to expansion of the print media in the crosstrack direction 102 because the print media cannot slip on the rollers 108, 110. Flutes can become permanent creases in the paper as the print media passes over a roller if the flutes have sufficient height as the print media approaches the roller and the wrap angle of the print media is high.

A number of solutions have been proposed to decrease the propensity of the print media to crease, such as ribbed rollers described in U.S. Pat. No. 8,303,106 to Kasiske, Jr. et al., issued Nov. 6, 2012, entitled "Printing system including web media moving apparatus," and profiled rollers described in co-pending U.S. patent application Ser. No. 14/106,911 to Piatt et al., filed Dec. 16, 2013, entitled "Transport using peaked web guide and roller," both included in their entirety herein by reference. These rollers act to spread the media during the wrap. These methods have met with measured success but there is an ongoing need to provide digital printing systems and processes with the ability to effectively handle print media expansion associated with the absorption of water by the print media.

SUMMARY OF THE INVENTION

According to an aspect of the invention, an apparatus for shaping a moving continuous web of print media in a printing system to reduce formation of wrinkles in the web of print media comprises a roller having an axis of rotation and a diameter, the roller including a first section, a second section, and a third section, the second section being located between the first section and the third section as viewed along the axis of rotation, the roller including a profile as viewed along the axis of rotation in which the diameter of the roller in the first section and the diameter of the roller in the third section are each greater than the diameter of the roller in the second section; a non-rotating vacuum assembly having an arcuate surface including a first section, a second section, and a third section, the second section being located between the first section and the third section, the arcuate surface including an extremum point located in the second section, the vacuum assembly providing a vacuum force proximate to the first side of the web of print media; and the vacuum assembly being positioned along a media travel path immediately upstream relative to the roller, the first section, the second section, and the third section of the vacuum assembly corresponding to the first section, the second section, and the third section of the roller, wherein the contour of the arcuate surface of the vacuum assembly causes the web of print media, after leaving the vacuum assembly, to have a non-linear profile in a direction perpendicular to the media travel path so that the web of print media contacts the first section and the third section of the roller prior to contacting the second section of the roller.

The present invention provides significant advantages over prior art. The web of print media is shaped by the vacuum assembly or the transport member to assume a non-linear convex profile prior to entering the high wrap angle concave roller. The concave roller shapes the web of print media in to an opposite concave profile. This shaping and reshaping of the web of print media enhances the spreading factor of the high wrap angle concave roller and further reduces the formation of wrinkles in the web of print media as it passes over the high wrap angle roller.

BRIEF DESCRIPTION OF THE DRAWINGS

In the detailed description of the example aspects of the invention presented below, reference is made to the accompanying drawings, in which.

DETAILED DESCRIPTION OF THE INVENTION

Figure 1:
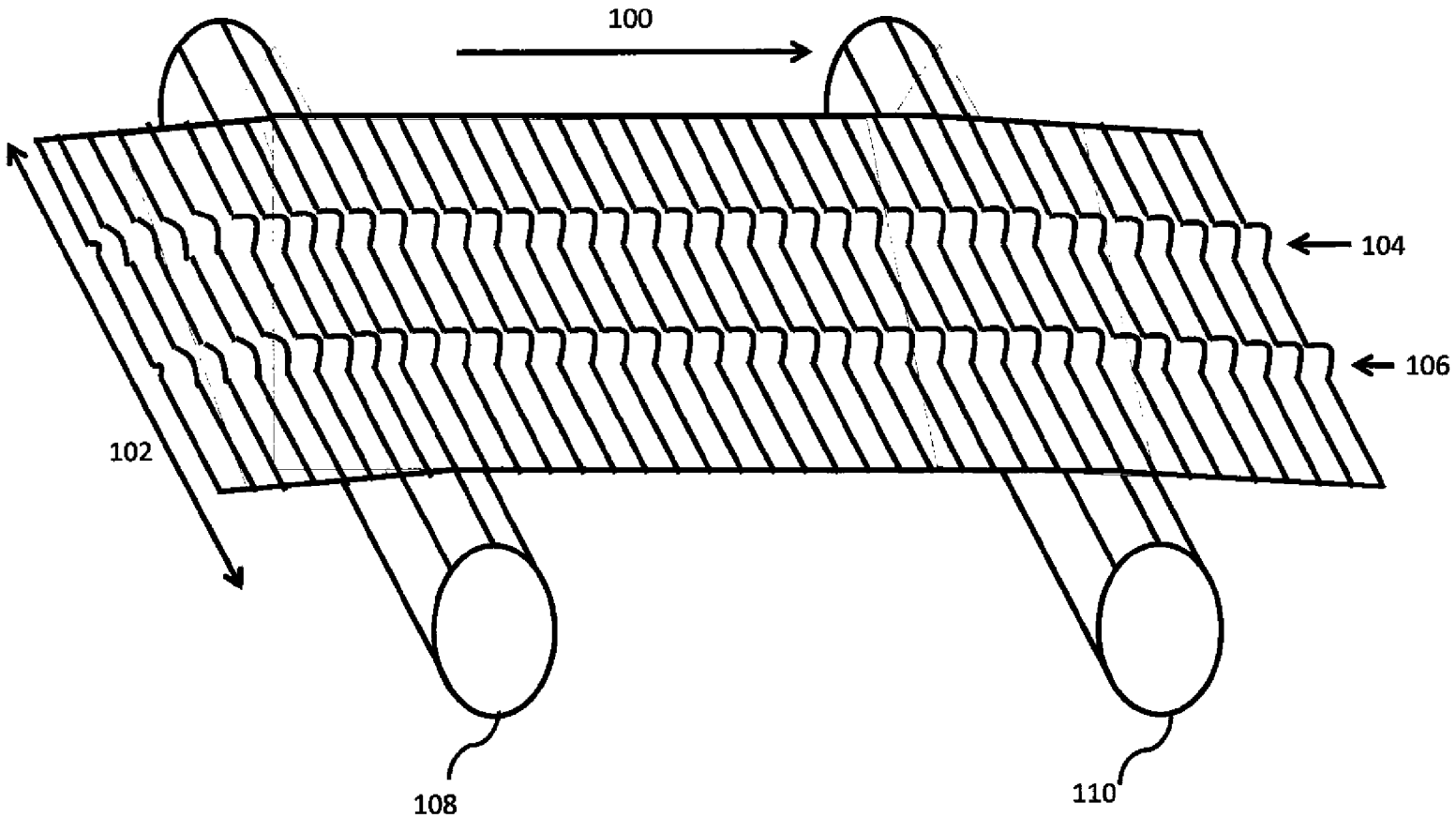
FIG. 1 (PRIOR ART)
FIG. 1 is a schematic of a portion of the print media as the print media passes over two conventional rollers that support the print media under each row of printheads in accordance with the prior art.

The present description will be directed in particular to elements forming part of, or cooperating more directly with, a web transport system. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example aspects of the present invention are illustrated schematically and not to scale for the sake of clarity. One of ordinary skill in the art will be able to readily determine the specific size and interconnections of the elements of the example aspects of the present invention.

As described herein, the example aspects of the present invention provide a printhead or printhead components typically used in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. Other non-ink liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquid is applied in a consistent, metered fashion, particularly if the desired result is a thin layer or coating.

Inkjet printing is a non-contact application of an ink to a print media. Typically, one of two types of ink jetting mechanisms are used and are categorized by technology as either drop on demand ink jet (DOD) or continuous ink jet (CIJ). The invention described herein is applicable to both types of printing technologies. As such, the terms printhead, linehead, and nozzle array, as used herein, are intended to be generic and not specific to either technology.

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

Aspects of the present invention are described herein with respect to an inkjet printing system. However, the term "printing system" is intended to be generic and not specific to inkjet printing systems. The invention is applicable to other types of printing systems, such as offset or traditional printing press technologies that print on a print media as the print media passes through the printing system.

Figure 2:
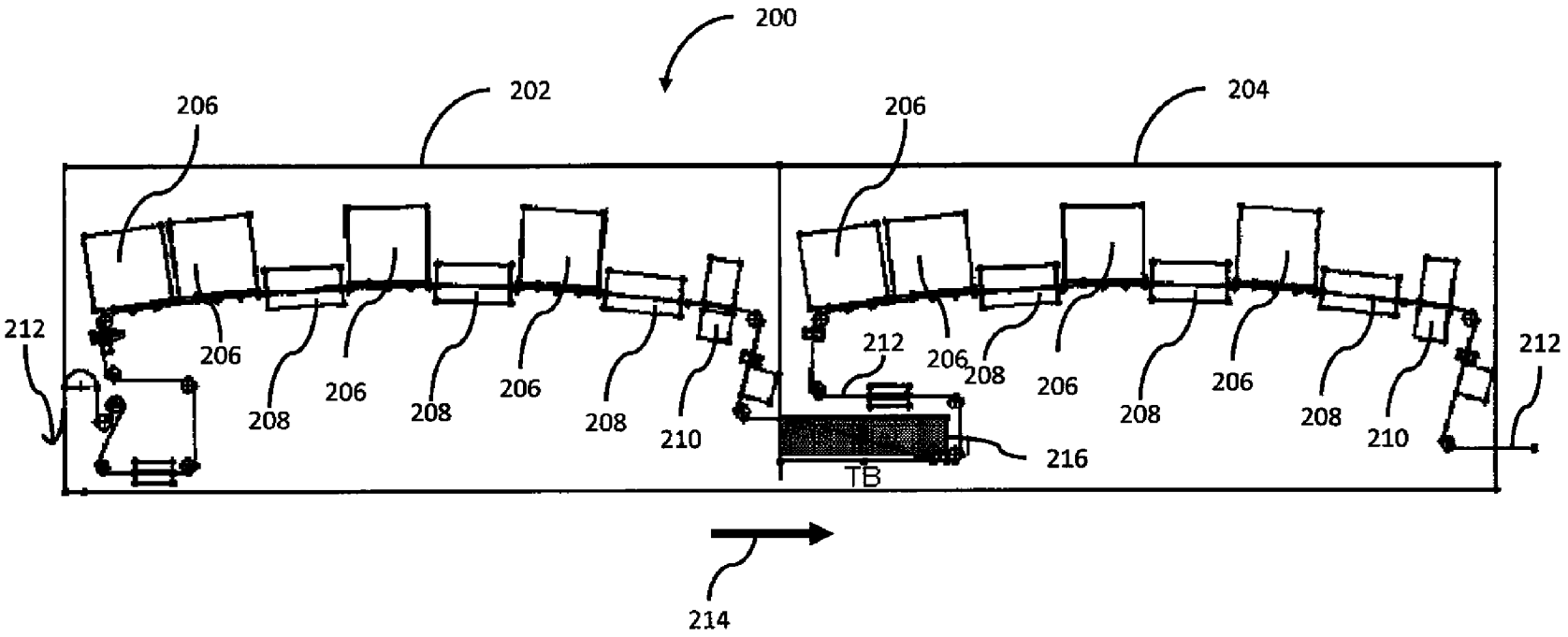
FIG. 2 is a schematic side view of a printing system for printing on a continuous web of print media made in accordance with the present invention.

The terms "upstream" and "downstream" are terms of art referring to relative positions along the transport path of the print media; points on the transport path move from upstream to downstream. In FIG. 2, the print media moves in a direction indicated by feed direction arrow 214. Where they are used, terms such as "first", "second", and so on, do not necessarily denote any ordinal or priority relation, but are simply used to more clearly distinguish one element from another.

Referring now to FIG. 2, there is shown a printing system for printing on a continuous web of print media. The web of print media is continuous as the print media passes through the printing system. The printing system 200 includes a first module 202 and a second module 204, each of which includes lineheads 206, dryers 208, and a quality control sensor 210. The lineheads 206, dryers 208, and quality control sensors 210 are positioned opposite a first side of the print media 212. In addition, the first module 202 and the second module 204 include a web tension system (not shown) that serves to physically move the print media 212 through the printing system 200 in the feed direction 214 (left to right in the figure).

The print media 212 enters the first module 202 from a source roll (not shown). The print media 212 is supported and guided through the printing system by rollers (not shown) without the need for a transport belt to guide and move the print media through the printing system. The linehead(s) 206 of the first module applies ink to the first side of the print media 212. As the print media 212 feeds into the second module 204, there is a turnover mechanism 216 which inverts the print media 212 so that linehead(s) 206 of the second module 204 can apply ink to the second side of the print media 212. The print media 212 then exits the second module 204 and is collected by a print media receiving unit (not shown).

As the print media 212 passes through the printing system, the one or more lineheads 206 selectively deposit ink on the print media in response to the image data to be printed. The water in the ink can cause the print media to expand. This can cause flutes to form in the print media as described earlier. It is desirable to suppress the flutes before the print media passes over a high wrap angle roller, such as roller following the image quality sensor 210 around which the print media wraps at a high wrap angle, preferably approximately 90°. Flutes in the print media can cause the print media to wrinkle as it passes over the high wrap angle roller.

Figure 3:
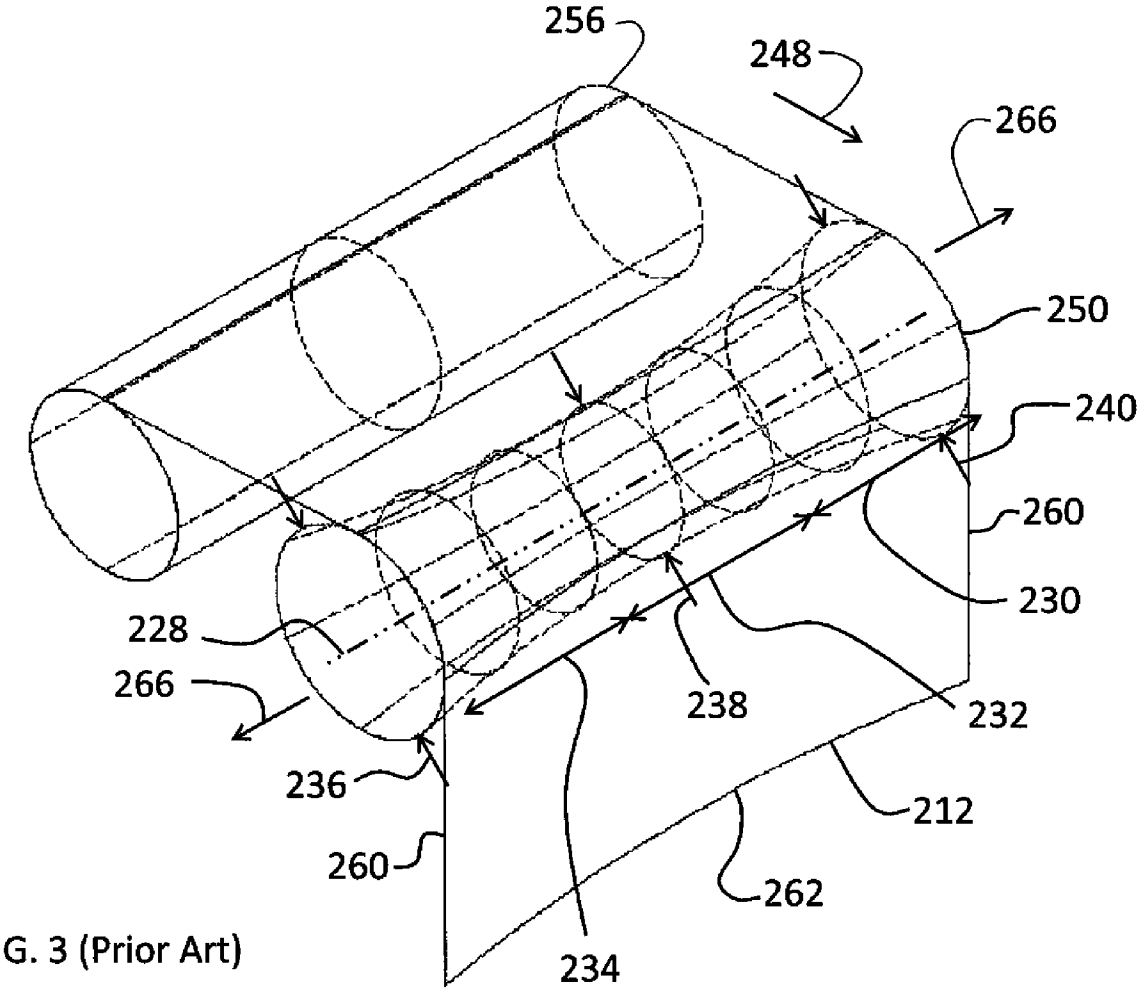
FIG. 3 (Prior Art)
FIG. 3 is a schematic perspective view of a portion of a prior art printing system for reducing the formation of wrinkles in a web of print media.

In the printing industry, fluting is commonly reduced by means of spreaders which produce tension to the print media in the crosstrack direction to stretch or spread the print media in the cross track direction. A well known type of spreader is a concave roller that rotates around an axis of rotation. Referring to prior art FIGS. 3 and 4, a concave roller 250 has a larger diameter 252 away from the center of the roller, near the outer edges of the print media, than the diameter 254 near the center of the roller, toward the center of the print media. Stated another way, the concave roller 250 includes a first section 230, a second section 232, and a third section 234. The second section 232 is located between the first section 230 and the third section 234 as viewed along the axis of rotation 228. The roller 250 includes a profile as viewed along the axis of rotation in which the diameter 252 of the roller in the first section 230 and the diameter 253 of the roller in the third section 234 are each greater than the diameter 254 of the roller in the second section 232. In FIG. 3, the print media 212 is shown moving from a straight transport roller 256. The operation of the concave roller 250 as a spreader is understood at least in part to be the result of the normal entry rule for media guiding rollers. The normal entry rule indicates that the print media approaching a roller will tend to align itself normal, or perpendicular, to the line of contact of the print media to the roller. The contour of concave roller 250 produces a curvature in the line of contact 258 of the approaching print media 212 to the concave roller.

Figure 4:
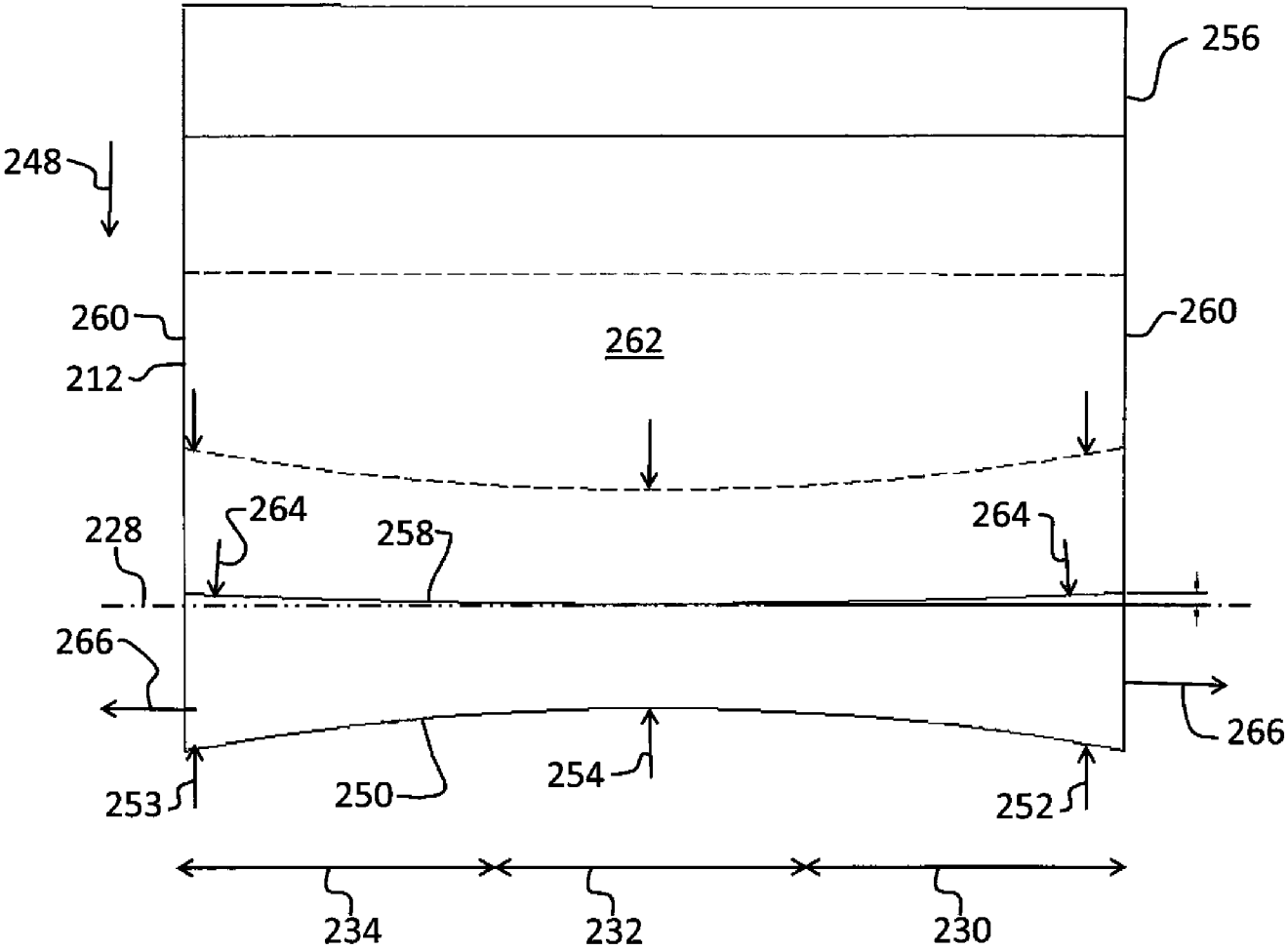
FIG. 4 (Prior Art)
FIG. 4 is a schematic top view of the portion of the prior art system shown in FIG. 3.
Figure 5:
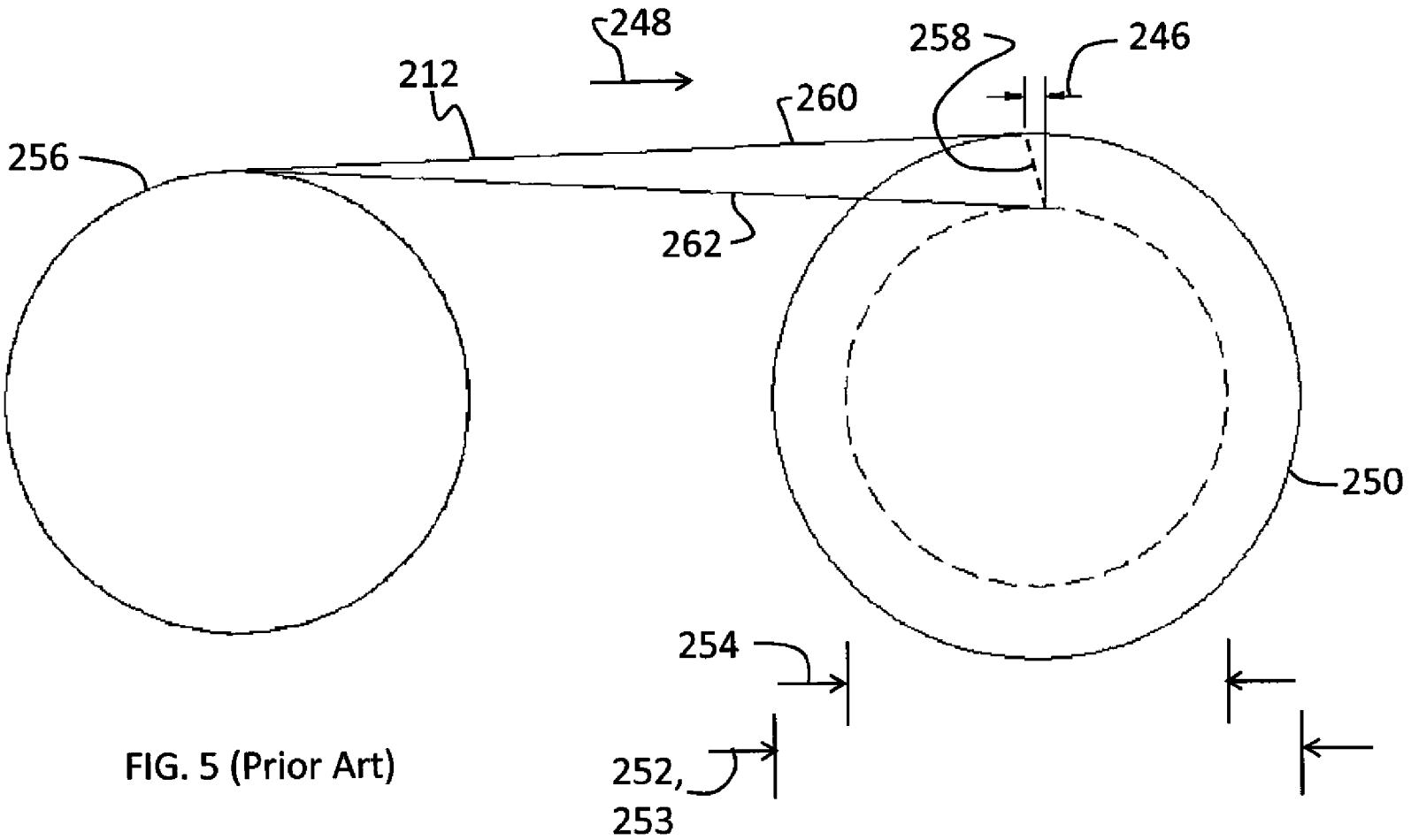
FIG. 5 (Prior Art)
FIG. 5 is a schematic side view of the portion of the prior art system shown in FIG. 3.

Referring to prior art FIGS. 4 and 5, the outer edges 260 of the print media contact the concave roller in advance of the central portion 262 of the print media. The curvature of the line of contact 258 near the edges of the print media causes the normals 264 to the contact line to flare outward near the outer edges 260 of the print media 212. The normal entry rule therefore indicates that the edges of the print media will tend to migrate away from the center, spreading the print media as indicated by arrows 266. The amount of spreading that can be achieved relative to the initial width of the print media by a concave roller of other spreader is commonly called the spreading factor of the roller or other spreader.

Figure 6:
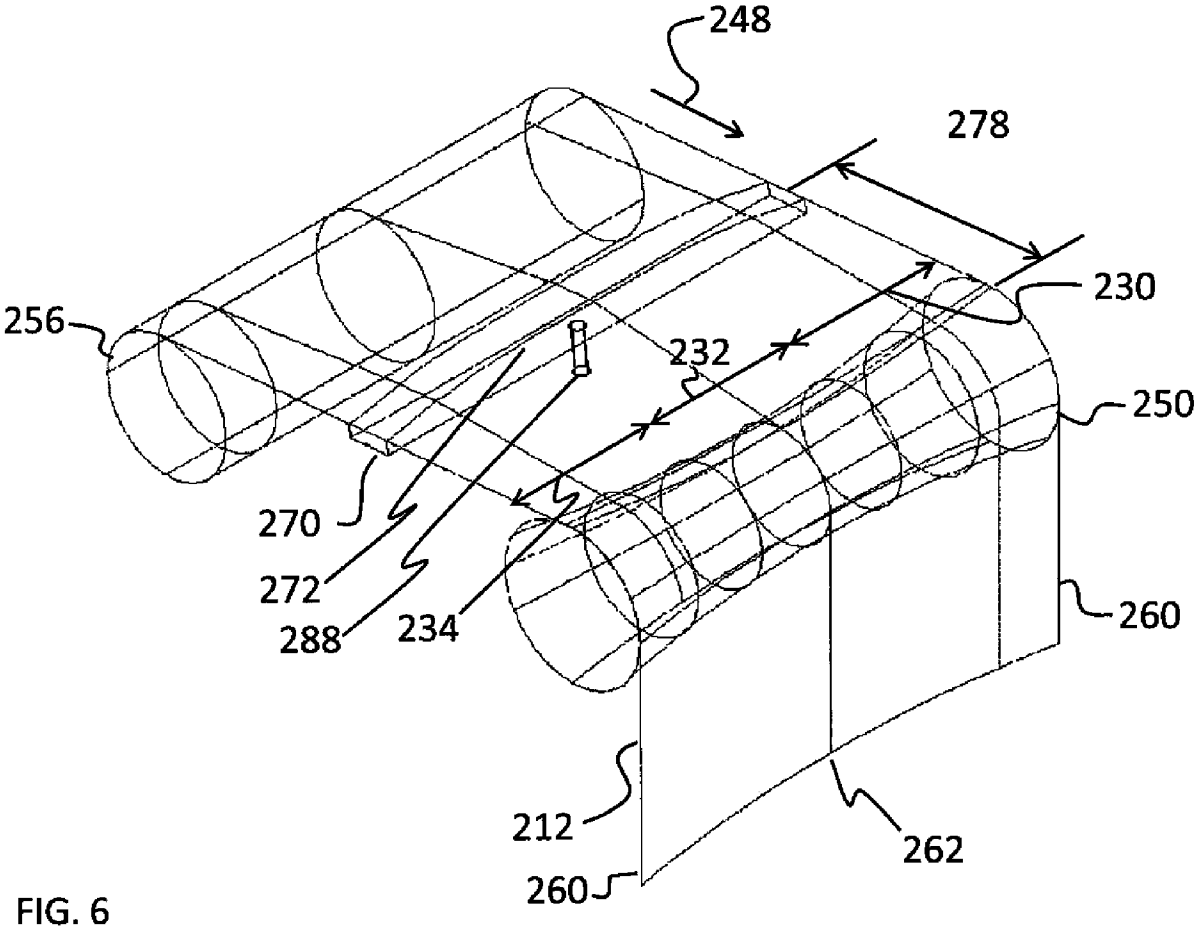
FIG. 6 is a schematic perspective of an example aspect of the present invention showing a vacuum assembly for shaping the profile of the web of print media.

In one aspect of the present invention, the spreading factor of the concave roller 250 is enhanced by placing a non-rotating vacuum assembly 270 upstream of the concave roller, as shown in FIG. 6. The vacuum assembly 270 is disposed between the straight roller 256 and concave roller 250. The vacuum assembly 270 has a vacuum manifold 272 and an arcuate surface with a convex profile. The arcuate surface has a peak near the center of the vacuum assembly. Stated another way, the vacuum assembly 270 includes a first section, a second section, and a third section with the second section being located between the first section and the second section. The peak in the arcuate surface of the vacuum assembly 270 is located in the second section of the vacuum assembly. The peak is directed toward the print media. The first, second, and third sections of the arcuate contact surface of the vacuum assembly 270 correspond with the first, second, and third sections of the concave roller 250.

The vacuum assembly 270 can include mechanical or electrical means 288 for controlling the contouring of the web of print media by adjusting the positioning the vacuum assembly. Moving the vacuum assembly upwards closer towards the web of print media increases the contouring and moving the vacuum assembly downward away from the web of print media decreases the contouring of the web due to the vacuum assembly. In this manner, different contouring can be provided for different types of web media. Metal sheet type of web media may require little to no contouring while thin newsprint type web media may require more contouring to reduce the formation of wrinkles in the web media. As described in co-pending U.S. patent application Ser. No. 14/040,843 to Piatt et al., filed Sep. 30, 2013, entitled "Integrated vacuum assist web transportation system," included in its entirety herein by reference, vacuum assembly 270 can include a vacuum source (not shown) connected to the vacuum assembly to provide vacuum in the vacuum manifold.

In this configuration, the vacuum assembly alters the contour of the print media 212 in the crosstrack direction upstream of the concave roller 250. As a concave roller 250 is known to be a spreading roller, one would expect that a vacuum assembly 270, whose contour is opposite that of the concave roller, would cause the edges of the print media 212 to migrate toward the center of the roller. This would cause the print media to bunch up near the center of the print media, and thereby increase the potential for fluting. It is known however that when there is slip between the print media and the convex shaped vacuum assembly, such as when there is only a small amount of wrap of the print media around the convex shaped vacuum assembly, a convex shaped vacuum assembly can serve as spreading roller.

Figure 7:
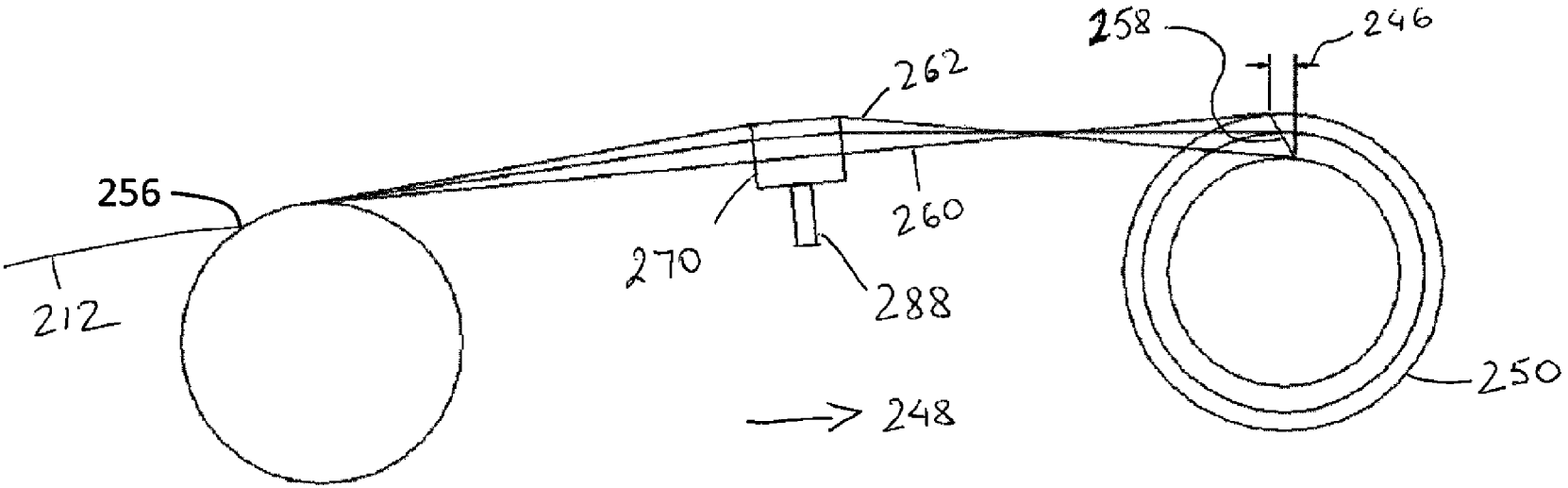
FIG. 7 is a schematic side view of the example aspect of the invention shown in FIG. 6.

As shown in FIG. 6, the invention utilizes both a vacuum assembly 270 and a concave roller 250 in combination to provide more spreading than can be achieved separately by the vacuum assembly 270 and the concave roller 250. It does so by placing the vacuum assembly 270 a short distance 278 upstream of the convex roller, and on the same side of the print media. FIG. 7 shows a schematic side view of the portion of the printing system shown in FIG. 6. The print media 212 leaving the vacuum assembly is crowned in the middle or central portion 262 of the web or print media, to match the contour of the arcuate surface of the vacuum assembly. Crowning the profile of the print media 212 in this manner causes the profile of the print media at the downstream concave roller 250 to be altered. The contact line 258 of the print media to the concave roller 250 at the outer edges 260 of the print media 212 is advanced by a greater advance distance 246 with respect to the contact line in the central portion 262 of the print media when compared to the advance distance 246 of the contact line at the outer edges with respect to the contact line 258 in the central portion 262 of the print media for the prior art system shown in FIG. 4. The contact line of the print media with the concave roller has increasing curvature when compared to the contact line with the concave roller downstream of a straight roller shown in FIG. 4. The upstream vacuum assembly, by producing a crowned profile to the print media, produces greater curvature to the contact line and therefore more divergence of the normals to the contact line. As a result the spreading factor is increased.

To avoid the potential of the vacuum assembly 270 inducing fluting before the print media arrives at the concave roller 250, the wrap angle of the print media around the vacuum assembly 270 is reduced as much as is permitted. Preferably, the wrap angle is less than or equal to 20°, and more preferably the wrap angle around the vacuum assembly is less than or equal to 5°. In the example aspect of the invention shown in FIG. 6, there is essentially no wrap of the print media, especially in the center region 262, around the vacuum assembly. The print media therefore travels along essentially a straight path from the straight roller 256 that is upstream of the vacuum assembly past the vacuum assembly to the concave roller 250. This minimal wrap allows the print media to slip as it passes over the vacuum assembly, reducing the tendency of the vacuum assembly to bunch the print media toward the center of the vacuum assembly.

The enhancement of the spreading factor depends on the spacing between the vacuum assembly and the concave roller. Referring to FIG. 6, the vacuum assembly 270 and the concave roller 250 are separated by a distance 278. As shown in FIG. 7, the contact line 258 of the print media on the concave roller is curved with the outer edges of the print media contacting the concave roller in advance of the central region of the print media; the advance distance is denoted by 246. The advance distance 246 is larger when the distance 278 between the vacuum assembly and the concave roller is smaller. The increase in the advance distance causes the spreading factor to be larger for smaller distances between the vacuum assembly and the concave roller. Preferably the distance 278 between the vacuum assembly and the concave roller is less than five times the larger outer edge diameter of the concave roller. More preferably the distance 278 between the vacuum assembly and the concave roller is less than 5 times the smaller center diameter of the concave roller.

As different print media have different spreader requirements, such as the need for spreading to avoid excessive fluting and tolerance for spreading to avoid damaging the print media, some aspects of the invention allow the engagement of the vacuum assembly between the concave roller and the upstream straight roller to be varied. Positioning hardware, not shown, can position the vacuum assembly 270 so that the outer edges of the print media are just contacting the vacuum assembly to provide more spreading. Positioning hardware can also be used to move the vacuum assembly closer to the concave roller or closer to the transport roller. For less spreading, the vacuum assembly 270 can be pivoted away from contact with the print media. For intermediate amounts of spreading the vacuum assembly can be positioned between the fully engaged and the unengaged positions.

An actuator 288 can be used to adjust the position of the web guide to enable the wrap of the print media around the vacuum assembly to be adjustable. With the vacuum assembly refracted, the spreading of the web of print media by the system is only that provided by the concave roller. As the vacuum assembly is moved into increasing contact with the print media, the print media is increasingly crowned by the arcuate surface of the vacuum assembly, thereby increasing the curvature of the line of contact with the concave roller and increasing the spreading factor of the print media.

Figure 8:
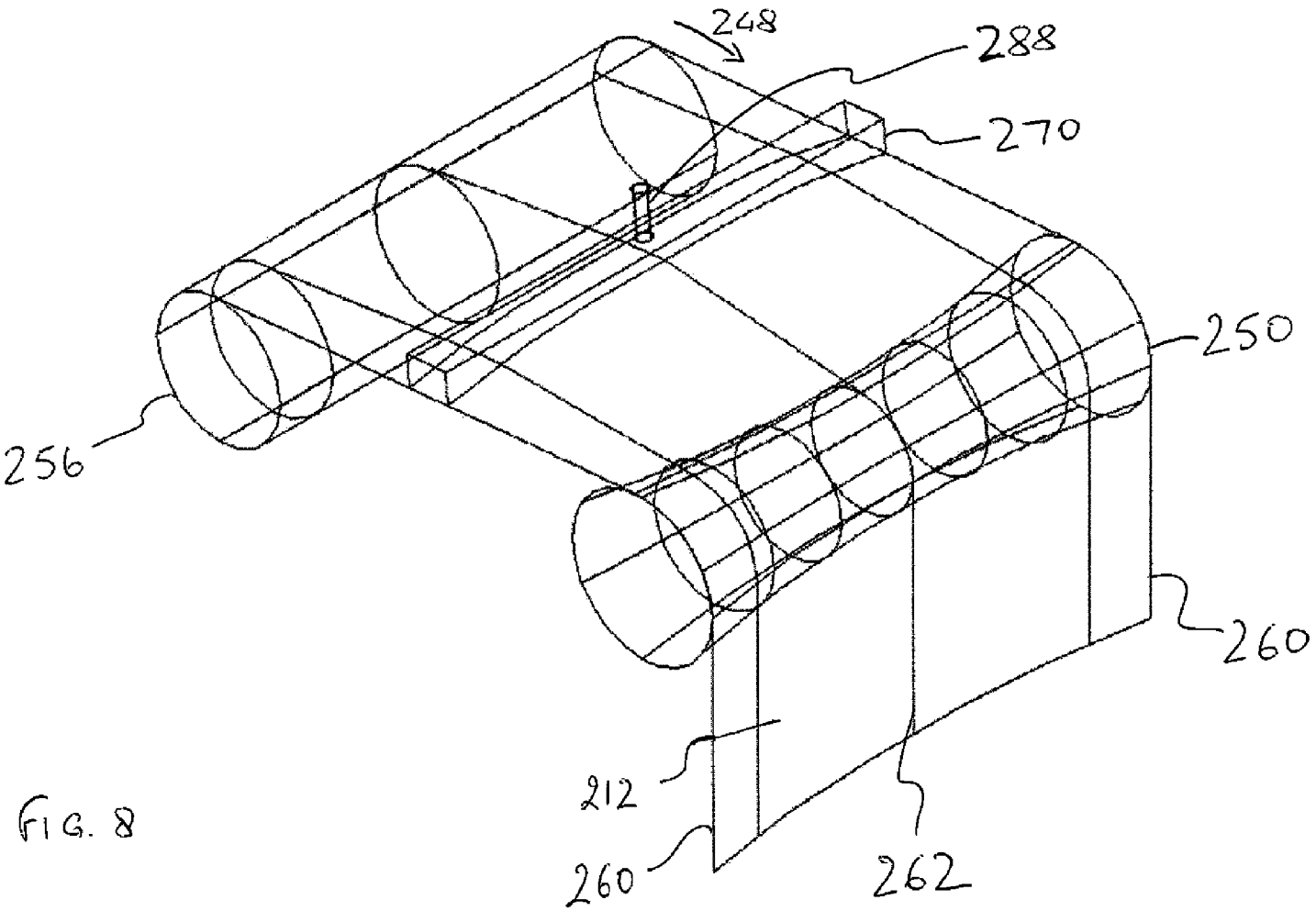
FIG. 8 is a schematic side view of another example aspect of the invention showing a vacuum assembly placed in an alternate configuration for shaping the profile of the web of print media.

In the system shown in FIG. 6, both the vacuum assembly and the concave roller are proximate or in contact with the same side of the web of print media. FIG. 8 shows an alternate configuration for the placement of the vacuum assembly 270 to achieve the spreading of the web of print media 212. In the system shown in the FIG. 8, the vacuum assembly 270 is placed on an opposite side of the web of print media 212 from the concave roller 250. It is still desirable to achieve a convex profile in the web of print media as it passes by the vacuum assembly 270. In this aspect of the invention, the vacuum assembly 270 has an arcuate surface with a concave profile. There is a valley in the profile of the arcuate surface in the second section of the vacuum assembly 270. Actuator 288 can be used to adjust the engagement of the vacuum assembly with the web of print media to control the contouring of the web of print media by the vacuum assembly.

Figure 9:
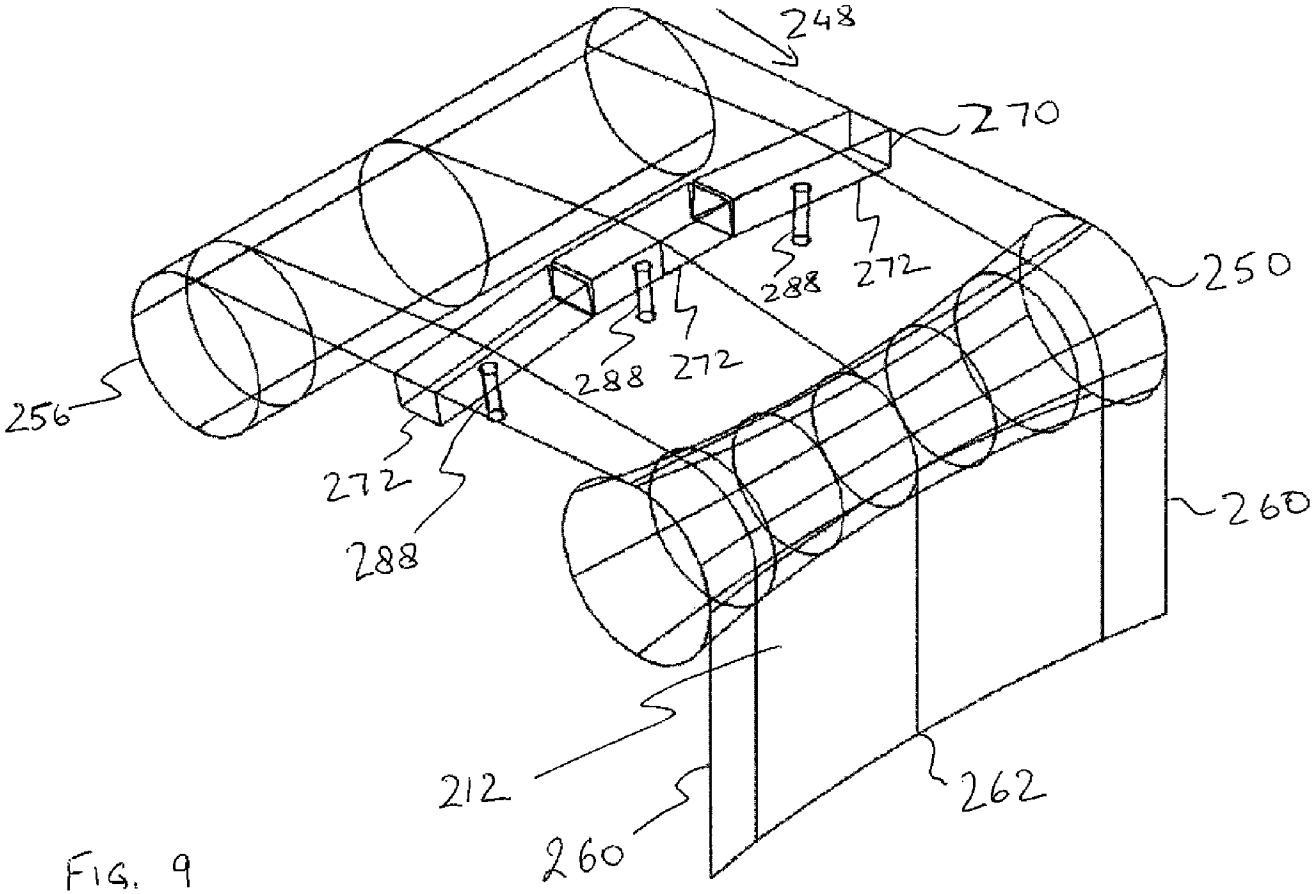
FIG. 9 is a schematic perspective of another example aspect of the invention showing a vacuum assembly with a plurality of vacuum manifolds for shaping the profile of the web of print media.

FIG. 9 is a schematic perspective of another example aspect of the invention showing a vacuum assembly with a plurality of vacuum manifolds for shaping the profile of the web of print media. In the example aspect shown in FIG. 9, there is a plurality of vacuum manifolds 272 arranged in an arcuate configuration to provide an arcuate surface for the vacuum assembly 270. The positions of each of the vacuum manifolds 272 can be individually adjusted using actuators 288 to provide a desired convex profile for the arcuate surface. Each of the vacuum manifolds 272 can have a straight linear surface profile or a non-linear profile. It is readily understood by one skilled in the art that the vacuum assembly 270 shown in FIG. 9 can be placed on the opposite side of the web of print media similar to the example aspect shown in FIG. 8. In the case where the vacuum assembly is positioned above the web media, the plurality of vacuum manifolds is arranged to provide an arcuate surface with a concave profile.

Figure 10:
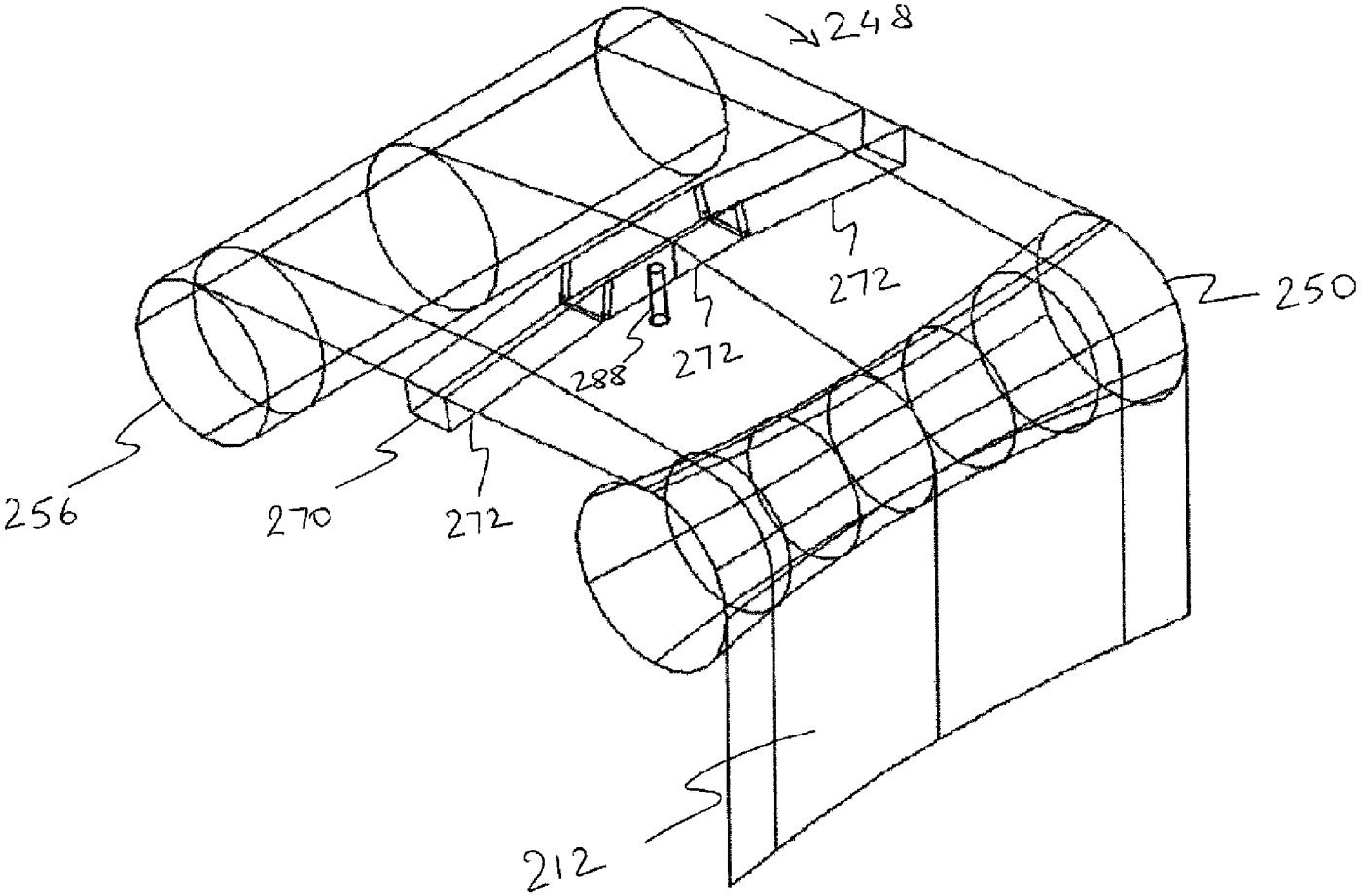
FIG. 10 is a schematic perspective of another example aspect of the invention showing a vacuum assembly with a hinged vacuum manifold for shaping the profile of the web of print media.

FIG. 10 is a schematic perspective of another example aspect of the invention showing a vacuum assembly with a vacuum manifold divided into a plurality of sections connected by a hinging mechanism for shaping the profile of the web of print media. The individual sections of the vacuum manifold can be adjusted using the hinging mechanism to achieve a desired arcuate profile for the vacuum assembly. Each individual section of the vacuum manifold can have a straight or arcuate surface profile.

Figure 11:
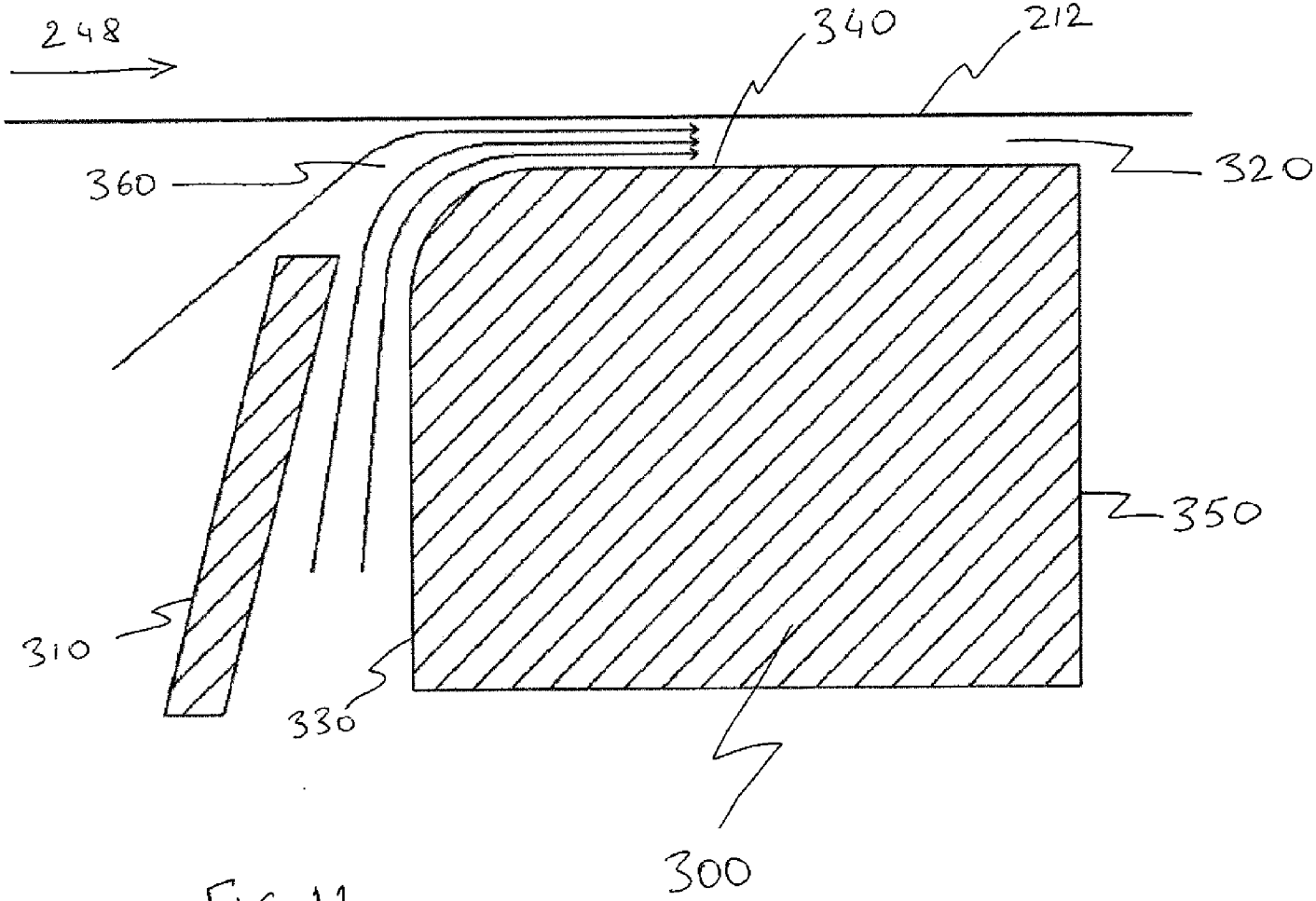
FIG. 11 is a schematic side view showing a portion of a system exhibiting a Coanda effect on the web of print media.

According to another aspect of the invention, a transport member including operative surface and an air clamp web stabilizer can be positioned upstream of the concave roller to produce the desired arcuate profile in the web of print media. FIG. 11 is a schematic side view showing a portion of a system for using the Coanda effect to shape the profiles of the web of print media. U.S. Pat. No. 6,936,137 to Moeller et al., issued Aug. 30, 2005, entitled "Air clamp stabilizer for continuous web materials," incorporated herein by reference in its entirety, describes a Coanda web stabilizer. Referring to FIG. 11, a transport member 300 includes an operative surface 340 proximate to the web of print media 212, a leading surface 330 and a trailing surface 350. There is an air gap 320 separating the operative surface 340 from the web of print media 212. An air clamp web stabilizer 310 is disposed proximate the leading surface 330 to control air flow 360 in the air gap 320. A converging nozzle (not shown) can be used in connection with an air plenum (not shown) to produce the accelerated air flow 360. The position of the air clamp web stabilizer 310 can be adjusted using well known mechanical or electrical means to control the velocity and volume of air flow 360 entering the air gap 320.

As described in U.S. Pat. No. 5,658,141 to Christian et al., issued Aug. 19, 1997, entitled "Device for spreading a flame by the Coanda effect," the Coanda effect is a known phenomenon in which a jet of air flowing at a high velocity remains attached to a tangential surface over which it flows. The air flow remains attached to the tangential surface even if the surface progressively diverges from its initial position by a certain angle. The high velocity of air between the web of print media 212 and the operative surface 340 produces, by Bernoulli principle, a low pressure region between the web of print media 212 and the operative surface 340. This low pressure region causes the web of print media 212 to be deflected closer to the operative surface 340. If the web of print media 212 is deflected too close to the operative surface 340, the reduction in the air gap 320 impedes the air flow 360 through the air gap 320 causing the suction force generated by the Coanda effect to drop off, eventually becoming a repulsive force at very small air gap sizes. When the air gap 320 between the web of print media 212 and the operative surface 340 is very small, the air flow 360 provides a positive force, pushing the web of print media 212 away from the operative surface 340. For a larger air gap, the force on the web of print media 212 becomes negative providing suction, pulling the web of print media 212 toward the operative surface 340. The web of print media 212 will therefore tend to stabilize at a defined air gap that depends on the air flow rate, the radius of curvature of the edge between the leading face 330 and the operative surface 340, the size and design of the nozzle.

Figure 12:
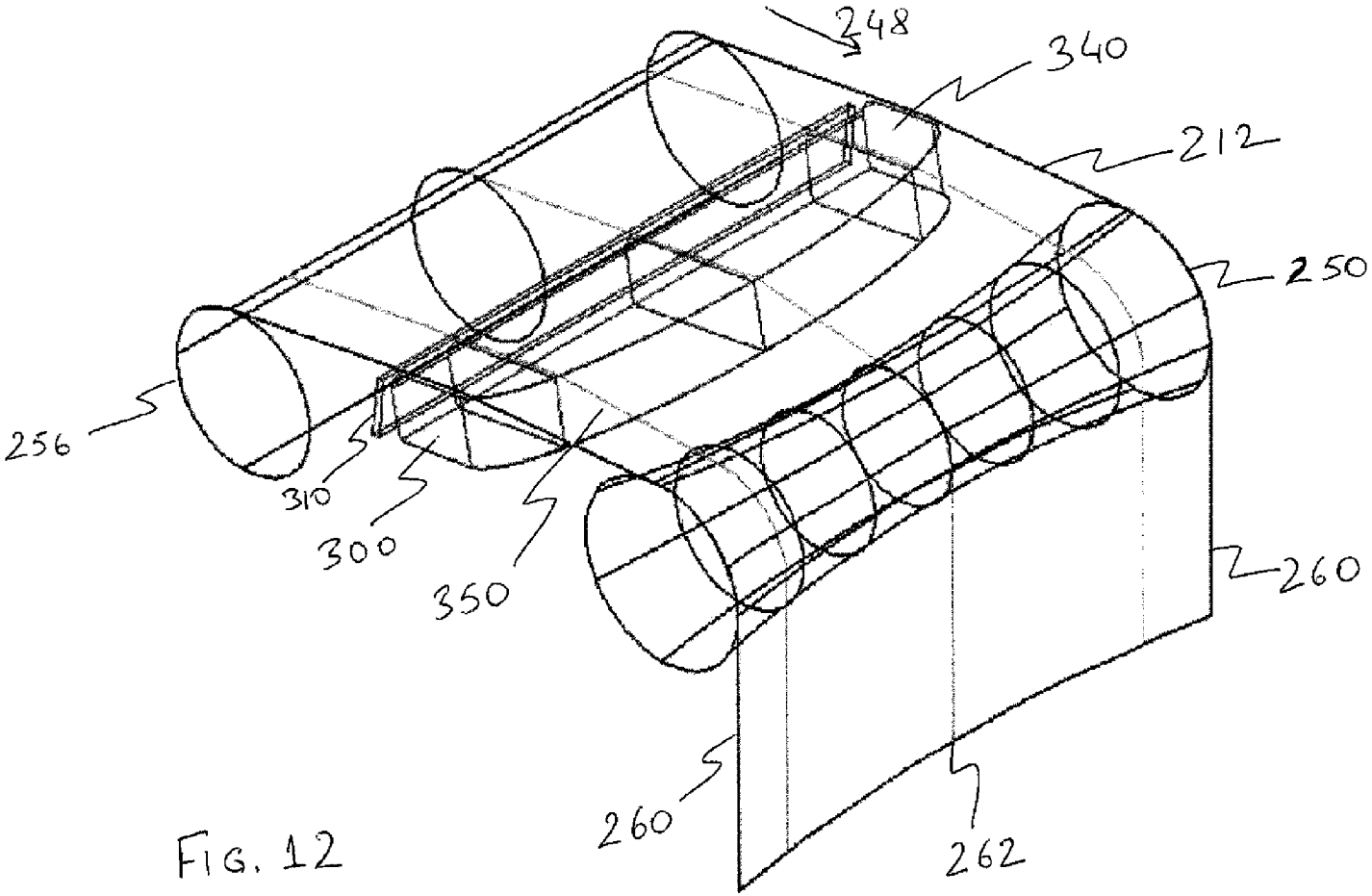
FIG. 12 is a schematic perspective of another example aspect of the present invention showing a transport member for using the Coanda effect to shape the profile of the web of print media.

FIG. 12 is a schematic perspective of another example aspect of the present invention showing a transport member that uses the Coanda effect to shape the profile of the web of print media. A non-rotating transport member 300 is disposed between the transport roller 256 and the concave roller 250. Air clamp web stabilizer 310 controls the flow of air between the operative surface 340 of the transport member 300 and the web of print media 212. The trailing surface 350 of the transport member 300 has a convex surface profile so that the edges 260 of the web of print media 212 pass by the transport member 300 before the center section 262 of the web of print media 212 passes by the transport member 300. The curved profile of the trailing surface 350 of the transport member 300 causes the edges of the web of print media 212 to deflect downwards towards the transport member 300 as the edges 260 of the print media pass by the edges of the trailing surface of the transport member. At this time, the center section 262 of the print media is still proximate the operative surface 340 of the transport member 300, causing the web of print media 212 to shape into a convex profile as it passes over the transport member. Adjustment means (not shown) can be used to adjust the position of the air clamp 310 to control the rate of air flow in the air gap between the operative surface 340 and the web of print media 212 to further shape the profile of the web of print media 212 as it passes over the transport member 300.

Figure 13:
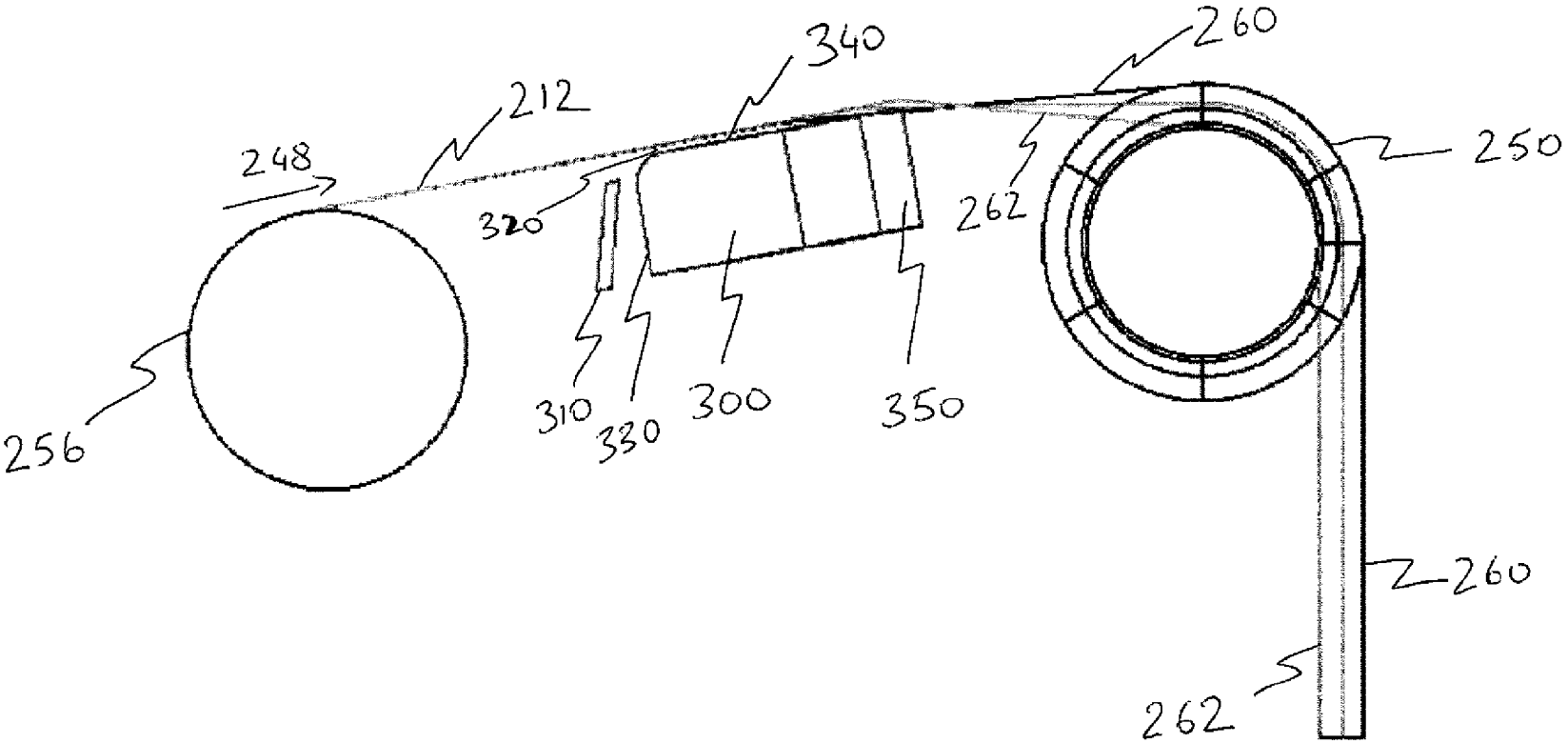
FIG. 13 is a schematic side view of the example aspect of the present invention shown in FIG. 12.

FIG. 13 is a schematic side view of the example aspect of the invention shown in FIG. 12. The edge 260 of the web of print media 212 is deflected more than the center section 262 of the web of print media as it passes over the transport member 300, creating a convex profile in the web of print media 212. However, the edge 260 of the web of print media is deflected less at the concave roller 250 than the center section 262. This causes the web of print media 212 to assume an opposite concave profile, thus spreading the web of print media 212 in the cross-track direction.

Figure 14:
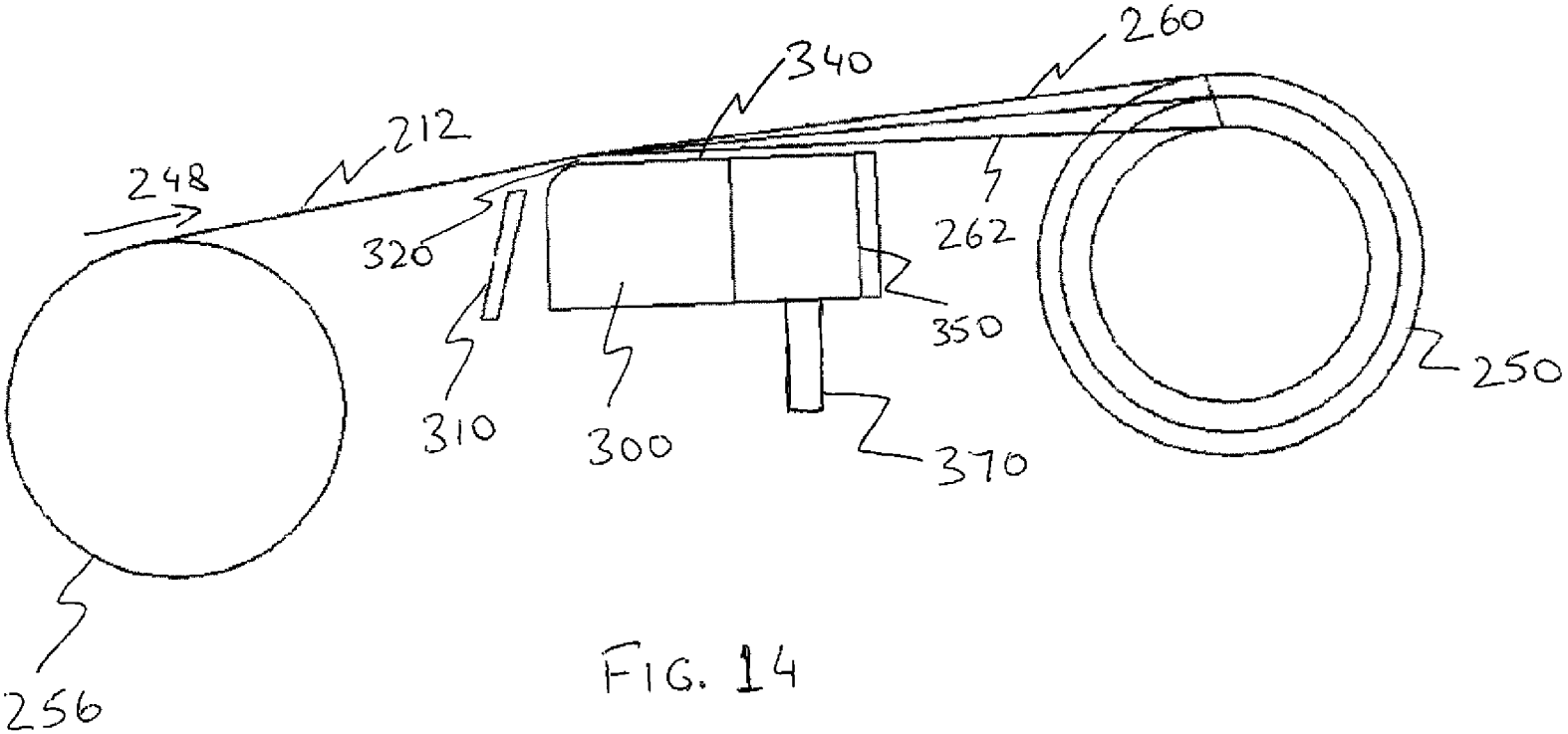
FIG. 14 is another schematic side view of the example aspect of the present invention shown in FIG. 12.

FIG. 14 shows an actuator 370 for adjusting the position of the transport member 300 to vary the contouring of the web of print media 212 as it leaves the transport member. As shown in FIG. 14, the transport member 300 is rotated downward at the trailing surface to reduce the Coanda effect operative in the air gap 320. This results in little to no contouring of the web of print media 212 as it passes over the transport member 300. The web of print media 212 assumes a concave profile when it passes over the concave roller 250.

Figure 15:
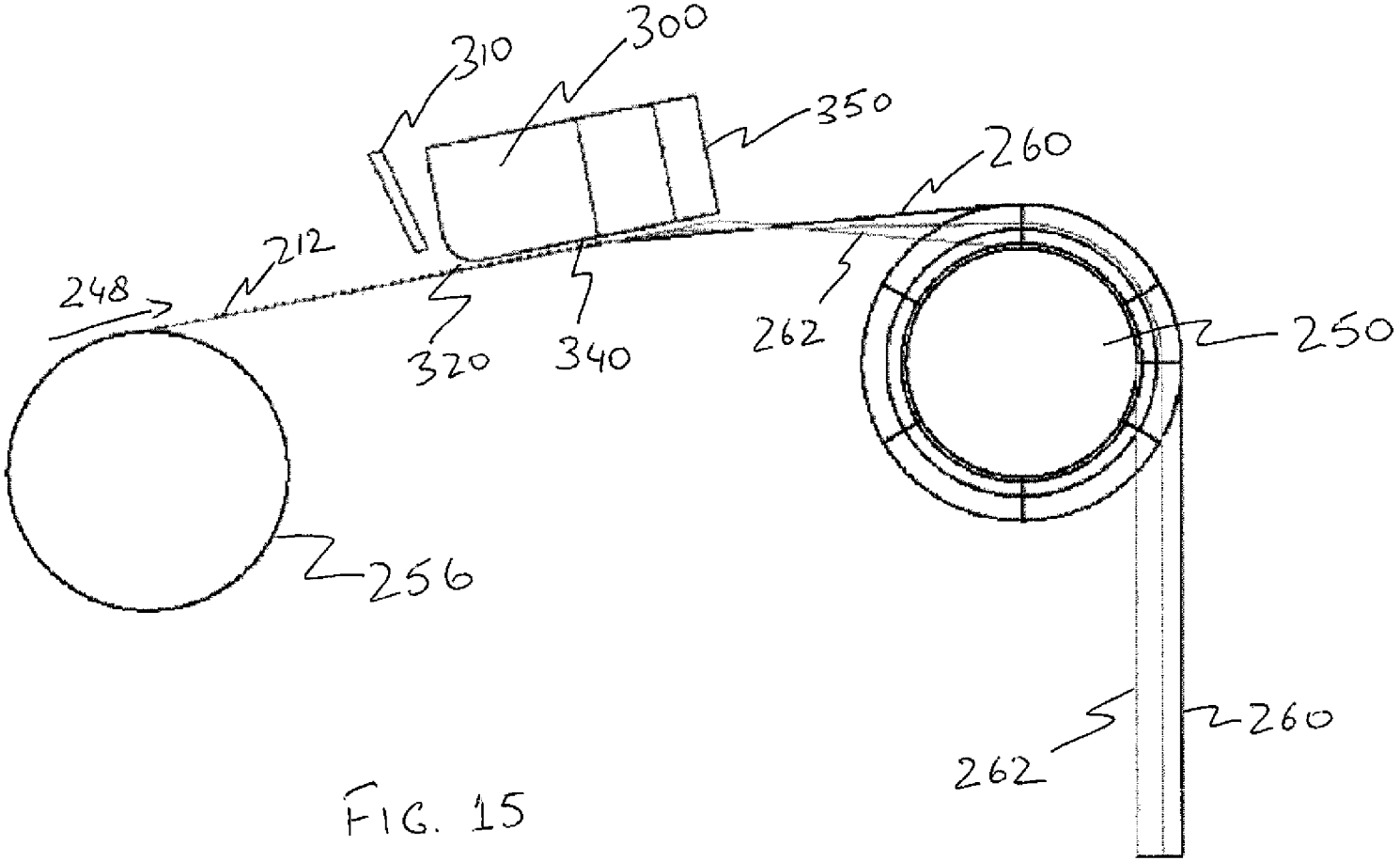
FIG. 15 is a schematic side view of another example aspect of the present invention showing an alternative placement of a transport member for using the Coanda effect to shape the profile of the web of print media.

FIG. 15 is a schematic side view showing an alternative placement of the transport member for using the Coanda effect to shape the profile of the web of print media. As shown in FIG. 15, the transport member 300 has an operative surface 340 proximate a first side of the web of print media 212. The concave roller 250 is proximate the second side of the web of print media 212. The trailing surface 350 of the transport member 300 has a concave profile so that the edges 260 of the web of print media pass by the transport member 300 after the center section 262 of the web of print media passes by the transport member. This causes the center section 262 of the web of print media to be deflected upwards toward the transport member 300, producing a convex profile in the web of print media 212 as it leaves the transport member 300.

Figure 16:
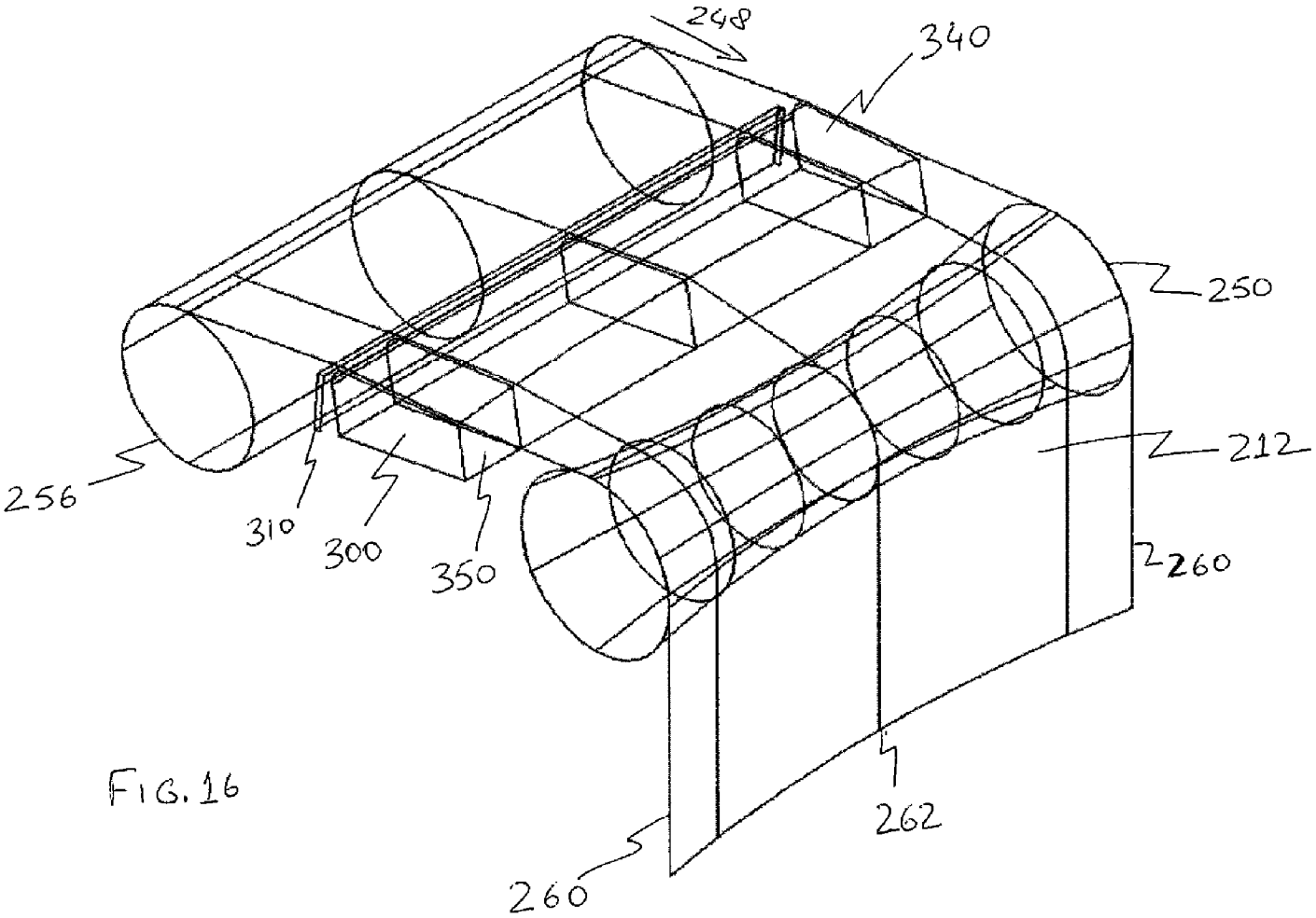
FIG. 16 is a schematic perspective of another example aspect of the present invention showing a transport member for using the Coanda effect to shape the profile of the web of print media.

FIG. 16 is a schematic perspective of another example aspect of the present invention showing a transport member that uses the Coanda effect to shape the profile of the web of print media. A non-rotating transport member 300 is disposed between the transport roller 256 and the concave roller 250. Air clamp web stabilizer 310 controls the flow of air between the operative surface 340 of the transport member 300 and the web of print media 212. The operative surface 340 of the transport member 300 has a convex surface profile so that the web of print media 212 assumes a convex profile as it passes by the transport member 300. The curved profile of the operative surface 340 of the transport member 300 causes the edges of the web of print media 212 to deflect downwards while the center section 262 of the web of print media 212 deflects upwards corresponding to the peak in the arcuate operative surface 340. This action causes the web of print media 212 to shape into a convex profile as it passes over the transport member. Adjustment means (not shown) can be used to adjust the position of the air clamp 310 to control the rate of air flow in the air gap between the operative surface 340 and the web of print media 212 to further shape the profile of the web of print media 212 as it passes over the transport member 300.

Figure 17:
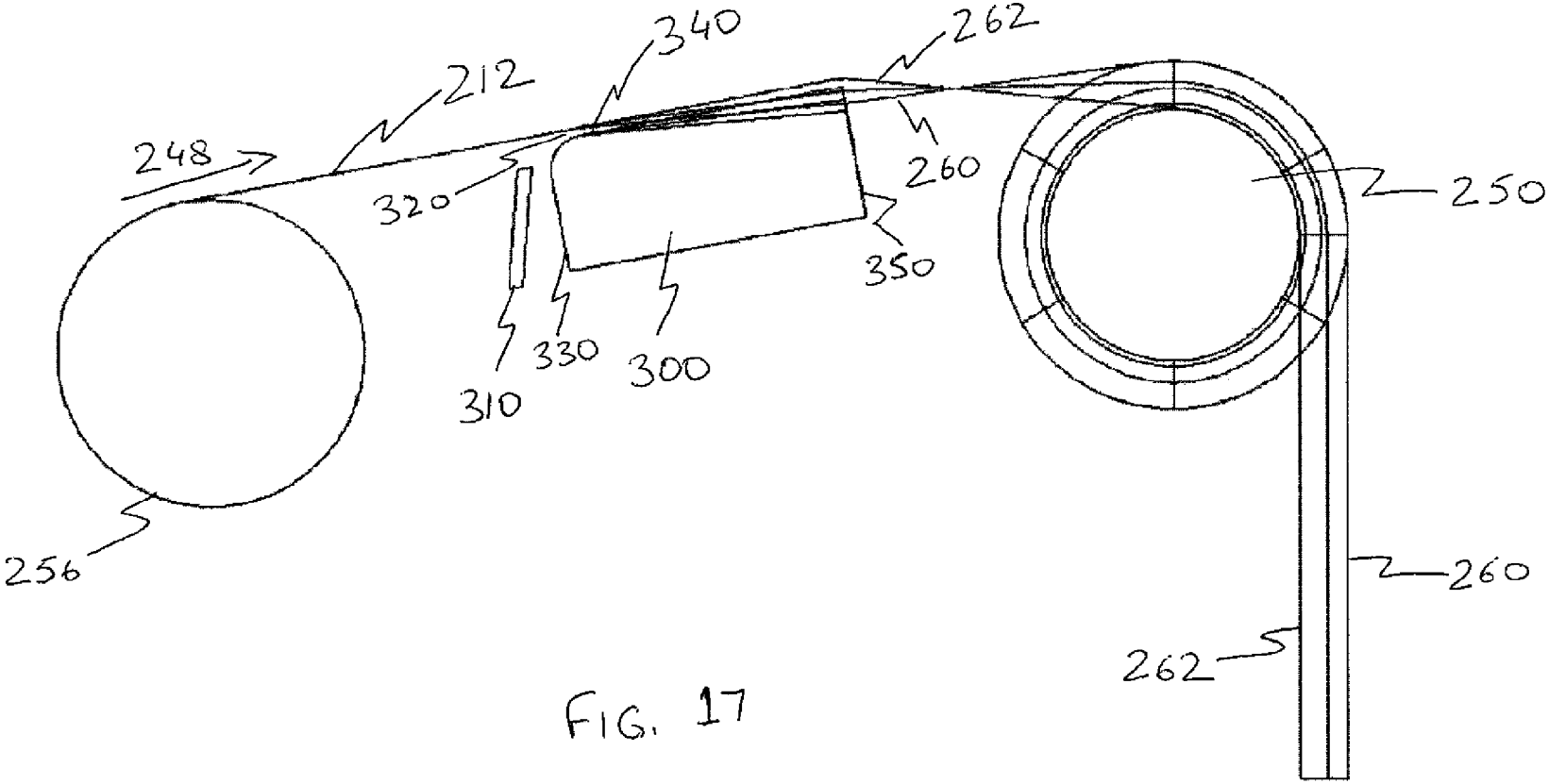
FIG. 17 is a schematic side view of the example aspect of the present invention shown in FIG. 16.

FIG. 17 is a schematic side view of the example aspect of the invention shown in FIG. 16. The edge 260 of the web of print media 212 is deflected more than the center section 262 of the web of print media as it passes over the transport member 300, creating a convex profile in the web of print media 212. However, the edge 260 of the web of print media is deflected less at the concave roller 250 than the center section 262. This causes the web of print media 212 to assume an opposite concave profile, thus spreading the web of print media 212 in the cross-track direction.

Figure 18:
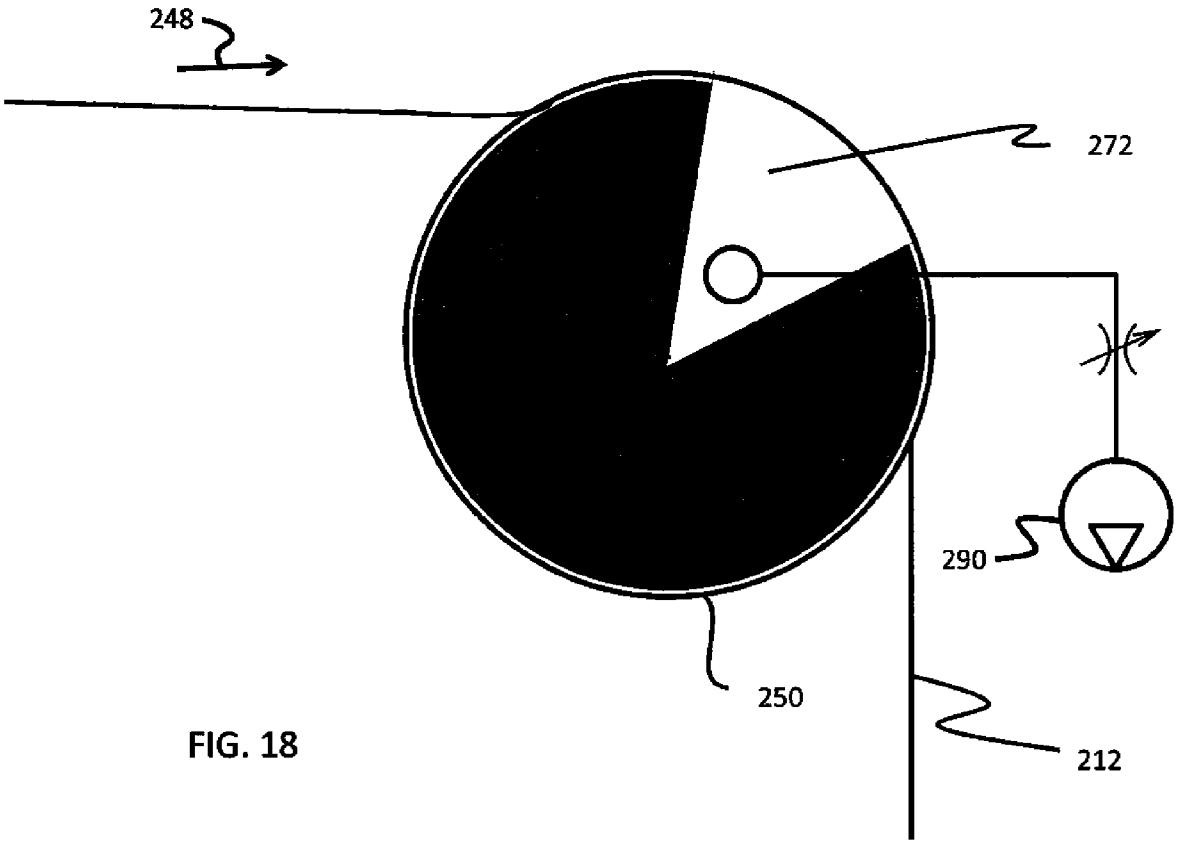
FIG. 18 is a side view of another example aspect of the invention showing a high wrap angle roller including a vacuum assembly for transporting the web of print media.

FIG. 18 is a side view of another example aspect of the invention showing a high wrap angle roller including a vacuum assembly for transporting the web of print media. Co-pending U.S. patent application Ser. No. 14/040,843 to Piatt et al., filed Sep. 30, 2013, entitled "Integrated vacuum assist web transport system,", incorporated herein by reference in its entirety, discloses a vacuum assembly for managing the transport of print media through a printing system. In Piatt et al., the vacuum assembly is disposed in a print zone opposite a linehead to deflect the print medium away from the linehead support structure.

In the aspect of the invention shown in FIG. 18, the vacuum assembly is integrated into the concave roller 250. The web of print media 212 wraps around the concave roller 250 with a high wrap angle. The concave roller 250 includes a vacuum manifold 272 connected to a vacuum source 290. The vacuum manifold operates on a non-print side of the web of print media 212 to deflect the print media toward the arcuate surface of the concave roller 250. The vacuum force pulling the web of print media 212 towards the concave roller 250 acts as a further spreading force on the web of print media, in a direction normal to the path of travel 248 of the web print media. This is same direction 266, shown in FIG. 4, as the spreading force generated by the curvature of the concave roller. This arrangement further reduces the likelihood of formation of wrinkles in the web of print media 212. The vacuum manifold 272 integrated into the concave roller 250 can have a linear profile or an arcuate profile to match the profile of the concave roller. In some aspects of the invention, the vacuum manifold can be designed to act on just the edge sections 260 of the web of print media 262. In other aspects of the invention, the vacuum manifold 272 can be designed to interact with just the central section 262 of the web of print media 212.

In the aspects of the invention shown in FIG. 18, the concave roller 250 includes a porous sleeve rotatable around a core. The core includes a vacuum manifold 272, which is connected to a vacuum source 290. The vacuum manifold can be of varying size to provide a larger or smaller surface area over which the vacuum operates. As an example, the core can be composed of compressible material that can be adjusted to change the effective size of the vacuum manifold. Further, the rotatable porous sleeve is engaged by the moving web of print medium that exerts a force on the porous sleeve causing it to rotate in a clockwise direction. The porous sleeve and the core can have a thin layer of air cushion to allow the sleeve to rotate around the core. In another example, the core can be made of material with low friction coefficient to allow the sleeve to rotate.

Figure 19:
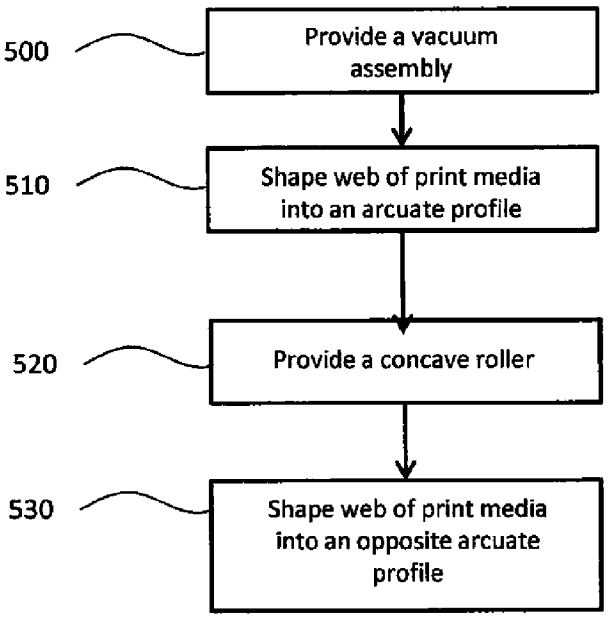
FIG. 19 is a flowchart for a method of reducing wrinkles in a web of print media using a vacuum assembly according to an aspect of the invention.

FIG. 19 shows a flowchart for a method of reducing wrinkles in a web of print media using a vacuum assembly according to an aspect of the invention. In Step 500, a vacuum assembly 270 having an arcuate profile is provided. The vacuum assembly 270 is disposed downstream of a printing zone of the printing system. In step 510, the vacuum assembly 270 is used to deflect the web of print media 212 moving through the printing system such that the web of print media 212 has a non-linear profile in a direction perpendicular to the media travel path 248. In Step 520, a concave roller 250 is provided. The concave roller 250 has an axis of rotation and a diameter. The concave roller includes a first section, a second section, and a third section, the second section being located between the first section and the third section as viewed along the axis of rotation. The concave roller 250 has a concave profile as viewed along the axis of rotation in which the diameter of the roller 250 in the first section and the diameter of the roller 250 in the third section are each greater than the diameter of the roller in the second section. This causes the web of print media 212 to contact the first section and the third section of the roller prior to contacting the second section of the roller. The web of print media wraps around the roller with a high wrap angle. In Step 530, the roller is used to deflect the web of print media in a direction opposite to that of the deflection of the web of print media by the vacuum assembly 270. This spreads the web of print media 212 in a cross-track direction to reduce the formation of wrinkles in the web of print media as it travels over the concave roller 250.

Figure 20:
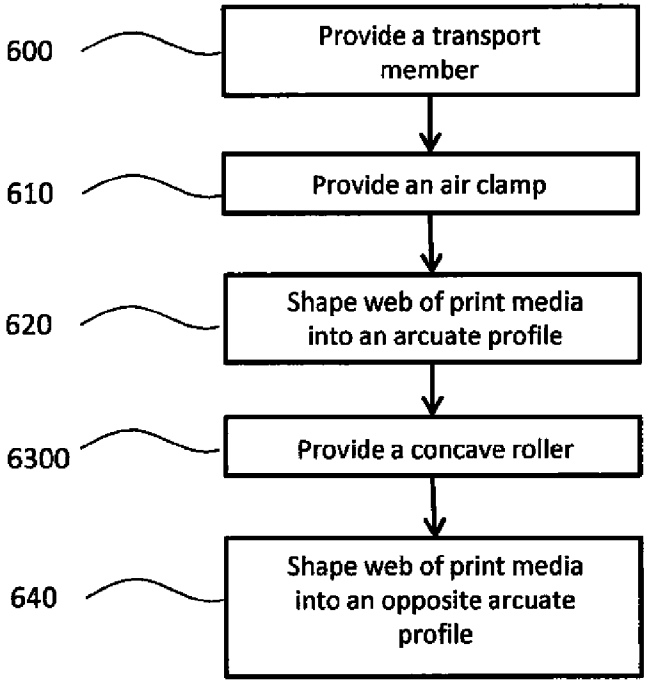
FIG. 20 is a flowchart for a method of reducing wrinkles in a web of print media using a transport member with an operative surface according to another aspect of the invention.

FIG. 20 is a flowchart for a method of reducing wrinkles in a web of print media using a transport member with an operative surface according to another aspect of the invention. In Step 600, a transport member 300 having an operative surface is provided. In Step 610, an air clamp web stabilizer is provided. The air clamp is disposed proximate to a leading surface of the transport member to control the air flow in the air gap between the operative surface of the transport member and a first side of the web of print media. The transport member 300 is disposed downstream of a printing zone of the printing system. In step 620, the transport member 270 is used to deflect the web of print media 212 moving through the printing system such that the web of print media 212 has a non-linear profile in a direction perpendicular to the media travel path 248. In Step 630, a concave roller 250 is provided. The concave roller 250 has an axis of rotation and a diameter. The concave roller includes a first section, a second section, and a third section, the second section being located between the first section and the third section as viewed along the axis of rotation. The concave roller 250 has a concave profile as viewed along the axis of rotation in which the diameter of the roller 250 in the first section and the diameter of the roller 250 in the third section are each greater than the diameter of the roller in the second section. This causes the web of print media 212 to contact the first section and the third section of the roller prior to contacting the second section of the roller. The web of print media wraps around the roller with a high wrap angle. In Step 640, the roller is used to deflect the web of print media in a direction opposite to that of the deflection of the web of print media by the transport member 300. This spreads the web of print media 212 in a cross-track direction to reduce the formation of wrinkles in the web of print media as it travels over the concave roller 250.

According to an aspect of the invention, an apparatus for shaping a moving continuous web of print media in a printing system to reduce formation of wrinkles in the web of print media comprises a roller having an axis of rotation and a diameter, the roller including a first section, a second section, and a third section, the second section being located between the first section and the third section as viewed along the axis of rotation, the roller including a profile as viewed along the axis of rotation in which the diameter of the roller in the first section and the diameter of the roller in the third section are each greater than the diameter of the roller in the second section. The apparatus also includes a non-rotating vacuum assembly having an arcuate surface including a first section, a second section, and a third section, the second section being located between the first section and the third section, the arcuate surface including an extremum point located in the second section, the vacuum assembly providing a vacuum force proximate to the first side of the web of print media. The vacuum assembly is positioned along a media travel path immediately upstream relative to the roller, the first section, the second section, and the third section of the vacuum assembly corresponding to the first section, the second section, and the third section of the roller, wherein the contour of the arcuate surface of the vacuum assembly causes the web of print media, after leaving the vacuum assembly, to have a non-linear profile in a direction perpendicular to the media travel path so that the web of print media contacts the first section and the third section of the roller prior to contacting the second section of the roller.

In another aspect of the invention, the apparatus also includes one or more sealing skid pads or one or more sealing rollers with an arcuate profile disposed adjacent to the first side of the web of print media and laterally adjacent to the vacuum assembly to prevent leakage of air. The wrap angle of the web of print media around the vacuum assembly is less than or equal to 20° and preferably less than or equal to 5°.

In some aspects of the invention, the vacuum assembly and the roller are spaced apart from each other by a distance of less than or equal to 5 times the minimum diameter of the second section of the roller.

The vacuum assembly and the roller can be positioned relative to each other such that both of the vacuum assembly and the roller contact the same side of the web of print media, In these aspects of the invention, the arcuate surface of the vacuum assembly is a convex surface. The vacuum assembly and the roller can also be positioned relative to each other such that the vacuum assembly and the roller contact opposite sides of the web of print media. In these aspects of the invention, the arcuate surface of the vacuum assembly is a concave surface.

The second section of the vacuum assembly and the second section of the roller are centered relative to each other and the web of print media. The vacuum assembly and the roller both include a contour of continuous curvature. The position of the vacuum assembly is adjustable to adjust a wrap angle of the web of print media around the vacuum assembly. The vacuum assembly includes a vacuum manifold and one or more guide surfaces. The guide surfaces have a convex or concave profile in the cross-track direction. The guide surfaces are rollers or fixed bars in contact with or in proximity to the first side of the web of print media. A vacuum source is connected to the vacuum manifold. In some aspects of the invention, the diameter of the first, second, or third sections of the vacuum assembly or the roller are variable. The diameters can be continuously variable.

According to another aspect of the invention, an apparatus for moving a continuous web of print media comprises a Coanda transport member having a Coanda slot comprising an operative surface, an air clamp web stabilizer, and an air gap between the operative surface and the web of print media. The apparatus includes a roller having an axis of rotation and a diameter, the roller including a first section, a second section, and a third section, the second section being located between the first section and the third section as viewed along the axis of rotation, the roller including a profile as viewed along the axis of rotation in which the diameter of the roller in the first section and the diameter of the roller in the third section are each greater than the diameter of the roller in the second section. The apparatus also includes a non-rotating transport member having an operative surface proximate a first side of the web of print media, the operative surface including a first section, a second section, and a third section, the second section being located between the first section and the third section, the operative surface having a non-linear profile including an extremum point located in the second section. The air clamp web stabilizer is located proximate to a leading surface of the transport member to control the air flow in an air gap between the operative surface of the transport member and the first side of the web of print media. The transport member is positioned along a media travel path immediately upstream relative to the roller, the first section, the second section, and the third section of the transport member corresponding to the first section, the second section, and the third section of the roller, wherein the profile of the operative surface of the transport member causes the web of print media, after leaving the transport member, to have a non-linear profile in a direction perpendicular to the media travel path so that the web of print media contacts the first section and the third section of the roller prior to contacting the second section of the roller.

In some aspects of the invention, the transport member and the roller are positioned relative to each other such that both of the transport member and the roller are proximate the same side of the web of print media. In these aspects of the invention, the profile of the operative surface is convex and the extremum point is a peak in the profile. In other aspects of the invention, the transport member and the roller are positioned relative to each other such that the transport member and the roller are proximate opposite sides of the web of print media. In these aspects of the invention, the profile of the operative surface is concave and the extremum point is a trough in the profile.

The transport member and the roller are preferably spaced apart from each other by a distance of less than or equal to 5 times the minimum diameter of the second section of the roller. The second section of the transport member and the second section of the roller are centered relative to each other and the web of print media. The profile of the transport member and the roller has a continuous curvature.

The apparatus further includes means for adjusting the position of the air clamp web stabilizer to control the amount of air flow entering the air gap between the web of print media and the operative surface of the transport member. The apparatus also includes means for adjusting the position of the transport member to control contouring of the web of print media by the operative surface. According to another aspect of the invention, an apparatus for moving a continuous web of print media comprises a Coanda transport member having a Coanda slot comprising an operative surface, an air clamp web stabilizer, and an air gap between the operative surface and the web of print media. The apparatus includes a roller having an axis of rotation and a diameter, the roller including a first section, a second section, and a third section, the second section being located between the first section and the third section as viewed along the axis of rotation, the roller including a profile as viewed along the axis of rotation in which the diameter of the roller in the first section and the diameter of the roller in the third section are each greater than the diameter of the roller in the second section. The Coanda non-rotating transport member has an operative surface proximate a first side of the web of print media, the transport member including a first section, a second section, and a third section, the second section being located between the first section and the third section, the operative surface being flat and having a non-linear profile for its trailing edge so that the edges of the web of print media pass by the trailing edge of the first and third sections of the transport member at a different time than the center of the web of print media passes by the trailing edge of the second section of the transport member. The air clamp is located proximate to a leading surface of the transport member to control the air flow in the gap between the operative surface of the transport member and the first side of the web of print media. The transport member is positioned along a media travel path immediately upstream relative to the roller, the first section, the second section, and the third section of the transport member corresponding to the first section, the second section, and the third section of the roller, wherein the profile of the trailing edge of the operative surface of the transport member causes the web of print media, after leaving the transport member, to have a non-linear profile in a direction perpendicular to the media travel path so that the web of print media contacts the first section and the third section of the roller prior to contacting the second section of the roller.

In some aspects of the invention, the transport member and the roller are positioned relative to each other such that both of the transport member and the roller are proximate the same side of the web of print media. In these aspects of the invention, the profile of the trailing edge of the operative surface is convex and the edges of the web of print media pass by the trailing edge of the first and third sections of the transport member before the center of the web of print media passes by the trailing edge of the second section of the transport member. In other aspects of the invention, the transport member and the roller are positioned relative to each other such that the transport member and the roller are proximate opposite sides of the web of print media. In these aspects of the invention, the profile of the trailing edge of the operative surface is concave and the edges of the web of print media pass by the trailing edge of the first and third sections of the transport member after the center of the web of print media passes by the trailing edge of the second section of the transport member.

In another aspect of the invention, an apparatus for moving a continuous web of print media includes a vacuum assembly having a plurality of vacuum manifolds arranged in an arcuate configuration to provide a first section, a second section, and a third section, the second section being located between the first section and the third section, the arcuate configuration of the vacuum assembly including an extremum point located in the second section, the plurality of vacuum manifolds providing a vacuum force proximate to the first side of the movable print medium. The vacuum assembly is positioned along a media travel path immediately upstream relative to the roller, the first section, the second section, and the third section of the configuration of the plurality of vacuum manifolds corresponding to the first section, the second section, and the third section of the roller such that the contour of the arcuate surface causes the web of print media, after leaving the vacuum assembly, to have a non-linear profile in a direction perpendicular to the media travel path so that the web of print media contacts the first section and the third section of the roller prior to contacting the second section of the roller. Each of the vacuum manifolds includes one or more guide surfaces having a straight or arcuate profile in the cross-track direction. One or more vacuum sources are connected to the plurality of vacuum manifolds.

In another aspect of the invention, an apparatus for causing a vacuum force to be applied across the width of a continuous web of print media as it moves through a printing system comprise a high wrap angle vacuum profiled roller. The roller is disposed in a non-print zone of the printing system, the roller having an axis of rotation and a diameter, the roller including a first section, a second section, and a third section, the second section being located between the first section and the third section as viewed along the axis of rotation, the roller including a profile as viewed along the axis of rotation in which the diameter of the roller in the first section and the diameter of the roller in the third section are each greater than the diameter of the roller in the second section, the roller including a vacuum assembly.

The roller includes one or more guide surfaces, wherein the one or more guide surfaces have a concave surface profile in the cross-track direction and are disposed proximate to a first side of the web of print media and a vacuum manifold disposed adjacent to the guide surfaces, wherein the vacuum manifold provides a vacuum force operating on the first side of the web of print media so that at least a portion of the web of print media is deflected towards the guide surfaces causing an increase in the spreading of the web of print media in a cross-track direction around the roller, thereby reducing the formation of wrinkles in the web of print media.

The concave profile of the guide surfaces forms an arcuate surface including a first section, a second section, and a third section, the second section being located between the first section and the third section, and the arcuate surface including a valley located in the second section. One or more sealing skid pads or one or more sealing rollers are disposed adjacent to the first side of the web of print media and laterally adjacent to the vacuum assembly to prevent leakage of air. The profile of the guide surfaces has continuous curvature. The guide surfaces are rollers or fixed bars in contact with or in proximity to the first side of the web of print media.

According to an aspect of the invention, a method for reducing the formation of wrinkles in a continuous web of print media in a printing system, comprises providing a vacuum assembly having an arcuate profile downstream of a printing zone of the printing system and using the vacuum assembly to deflect the web of print media moving through the printing system such that the web of print media has a non-linear profile in a direction perpendicular to a media travel path. The method also includes providing a roller having an axis of rotation and a diameter, the roller including a first section, a second section, and a third section, the second section being located between the first section and the third section as viewed along the axis of rotation, the roller including a concave profile as viewed along the axis of rotation in which the diameter of the roller in the first section and the diameter of the roller in the third section are each greater than the diameter of the roller in the second section, such that the web of print media contacts the first section and the third section of the roller prior to contacting the second section of the roller, and wherein the web of print media wraps around the roller with a high wrap angle and using the roller to deflect the web of print media in a direction opposite to that of the deflection of the web of print media by the vacuum assembly, thereby spreading the web of print media in a cross-track direction to reduce the formation of wrinkles in the web of print media as it travels over the roller.

The method further includes providing one or more sealing skid pads or one or more sealing rollers with an arcuate profile disposed adjacent to the first side of the movable print medium and laterally adjacent to the vacuum assembly and using the sealing skid pads or sealing rollers to prevent leakage of air into the vacuum assembly.

According to another aspect of the invention, a method for reducing the formation of wrinkles in a continuous web of print media in a printing system comprises providing a non-rotating transport member having an operative surface, providing an air clamp, disposing the air clamp proximate to a leading surface of the transport member to control the air flow in the gap between the operative surface of the transport member and a first side of the web of print media and using the transport member to deflect the web of print media moving through the printing system such that the web of print media has a non-linear profile in a direction perpendicular to a media travel path as the web of print media leaves the transport member. The method also includes providing a roller having an arcuate profile downstream of the transport member such that the web of print media contacts the first section and the third section of the roller prior to contacting the second section of the roller, and wherein the web of print media wraps around the roller with a high wrap angle and using the roller to deflect the web of print media in a direction opposite to that of the deflection of the web of print media by the transport member, thereby spreading the web of print media in a cross-track direction to reduce the formation of the wrinkles in the web of print media as it travels over the roller.

In some aspects of the invention, the operative surface has a non-linear profile in a direction perpendicular to a media travel path and the method further includes using the operative surface to impart to the web of print media a non-linear profile in a direction perpendicular to a media travel path. In other aspects of the invention, the operative surface has a trailing edge, the trailing edge having a non-linear profile in a direction perpendicular to a media travel path and the method further includes using the trailing edge of the operative surface to impart to the web of print media a non-linear profile in a direction perpendicular to a media travel path as the web passes over the trailing edge.

The invention has been described in detail with particular reference to certain preferred aspects thereof, but it will be understood that variations and modifications can be effected within the scope of the invention.

The invention claimed is:

1. An apparatus for shaping a moving continuous web of print media in a printing system to reduce formation of wrinkles in the web of print media, comprising:

a roller having an axis of rotation and a diameter, the roller including a first section, a second section, and a third section, the second section being located between the first section and the third section as viewed along the axis of rotation, the roller including a profile as viewed along the axis of rotation in which the diameter of the roller in the first section and the diameter of the roller in the third section are each greater than the diameter of the roller in the second section;

a non-rotating vacuum assembly having an arcuate surface including a first section, a second section, and a third section, the second section being located between the first section and the third section, the arcuate surface including an extremum point located in the second section, the vacuum assembly providing a vacuum force proximate to the first side of the web of print media; and the vacuum assembly being positioned along a media travel path immediately upstream relative to the roller, the first section, the second section, and the third section of the vacuum assembly corresponding to the first section, the second section, and the third section of the roller, wherein the contour of the arcuate surface of the vacuum assembly causes the web of print media, after leaving the vacuum assembly, to have a non-linear profile in a direction perpendicular to the media travel path so that the web of print media contacts the first section and the third section of the roller prior to contacting the second section of the roller.

2. The apparatus of claim 1 further including one or more sealing skid pads or one or more sealing rollers with an arcuate profile disposed adjacent to the first side of the web of print media and laterally adjacent to the vacuum assembly to prevent leakage of air.

3. The apparatus of claim 1, wherein the wrap angle of the web of print media around the vacuum assembly is less than or equal to 20°.

4. The apparatus of claim 1, wherein the wrap angle of the web of print media around the vacuum assembly is less than or equal to 5°.

5. The apparatus of claim 1, wherein the vacuum assembly and the roller are spaced apart from each other by a distance of less than or equal to 5 times the minimum diameter of the second section of the roller.

6. The apparatus of claim 1, wherein the vacuum assembly and the roller are positioned relative to each other such that both of the vacuum assembly and the roller contact the same side of the web of print media and wherein the arcuate surface of the vacuum assembly is a convex surface.

7. The apparatus of claim 1, wherein the vacuum assembly and the roller are positioned relative to each other such that the vacuum assembly and the roller contact opposite sides of the web of print media and wherein the arcuate surface of the vacuum assembly is a concave surface.

8. The apparatus of claim 1, wherein the second section of the vacuum assembly and the second section of the roller are centered relative to each other and the web of print media.

9. The apparatus of claim 1, wherein the vacuum assembly and the roller both include a contour of continuous curvature.

10. The apparatus of claim 1, wherein the position of the vacuum assembly is adjustable to adjust a wrap angle of the web of print media around the vacuum assembly.

11. The apparatus of claim 1, wherein the vacuum assembly includes a vacuum manifold and one or more guide surfaces, and wherein the one or more guide surfaces have a convex profile in the cross-track direction.

12. The apparatus of claim 11, wherein the guide surfaces are rollers or fixed bars in contact with or in proximity to the first side of the web of print media.

13. The apparatus of claim 11, further including a vacuum source connected to the vacuum manifold.

14. The apparatus of claim 1, wherein the diameter of the first, second, or third sections of the vacuum assembly or the roller are variable.

15. The apparatus of claim 14, wherein the diameter of the first, second, or third sections of the vacuum assembly or the roller are continuously variable.

* * * * *